US008384622B2

(12) United States Patent
Arai et al.

(10) Patent No.: US 8,384,622 B2
(45) Date of Patent: Feb. 26, 2013

(54) PLASMA DISPLAY PANEL DRIVE CIRCUIT AND PLASMA DISPLAY DEVICE

(75) Inventors: Yasuhiro Arai, Osaka (JP); Keiji Akamatsu, Osaka (JP); Toshikazu Wakabayashi, Osaka (JP); Mitsuhiro Murata, Kyoto (JP)

(73) Assignee: Panasonic Corporation, Osaka (JP)

( * ) Notice: Subject to any disclaimer, the term of this patent is extended or adjusted under 35 U.S.C. 154(b) by 1330 days.

(21) Appl. No.: 12/092,865

(22) PCT Filed: Dec. 20, 2007

(86) PCT No.: PCT/JP2007/074493

§ 371 (c)(1),
(2), (4) Date: May 7, 2008

(87) PCT Pub. No.: WO2008/090700

PCT Pub. Date: Jul. 31, 2008

(65) Prior Publication Data

US 2010/0149220 A1 Jun. 17, 2010

(30) Foreign Application Priority Data

Jan. 24, 2007 (JP) ..... 2007-013605

(51) Int. Cl.
*G09G 3/28* (2006.01)

(52) U.S. Cl. ..... 345/60; 345/690

(58) Field of Classification Search ..... 345/60–72, 345/690–697

See application file for complete search history.

(56) References Cited

U.S. PATENT DOCUMENTS

| | | | | |
|---|---|---|---|---|
| 6,066,923 | A | 5/2000 | Noborio et al. | |
| 6,369,514 | B2 | 4/2002 | Awamoto | |
| 6,538,627 | B1 * | 3/2003 | Whang et al. | 345/60 |
| 6,603,446 | B1 | 8/2003 | Kanazawa et al. | |

(Continued)

FOREIGN PATENT DOCUMENTS

| | | |
|---|---|---|
| JP | 11-095717 | 4/1999 |
| JP | 11-327503 | 11/1999 |

(Continued)

OTHER PUBLICATIONS

English language Abstract of JP 2003-043989.

(Continued)

*Primary Examiner* — Michael Pervan
(74) *Attorney, Agent, or Firm* — Greenblum & Bernstein, P.L.C.

(57) ABSTRACT

The total number of the scan electrodes is divided into a first scan electrode group and a second scan electrode group. The first scan electrode group drive section for driving the first scan electrode group produces a selection potential and a non-selection potential in the scan period, and supplies scan pulses based on the two potentials in the first half of the scan period. The complex switch section supplies the selection potential produced using the first scan electrode group drive section to the second scan electrode group drive section for driving the second scan electrode group in the latter half of the scan period. The second scan electrode group drive section supplies scan pulses based on the input selection potential.

13 Claims, 16 Drawing Sheets

U.S. PATENT DOCUMENTS

| | | | | |
|---|---|---|---|---|
| 2001/0028225 | A1 | 10/2001 | Awamoto | |
| 2005/0219157 | A1* | 10/2005 | Lee | 345/63 |
| 2006/0038750 | A1 | 2/2006 | Inoue et al. | |
| 2007/0115219 | A1 | 5/2007 | Inoue | |
| 2007/0188415 | A1 | 8/2007 | Inoue | |
| 2007/0188416 | A1 | 8/2007 | Inoue | |
| 2007/0195051 | A1 | 8/2007 | Ikeda | |
| 2007/0268216 | A1 | 11/2007 | Aria et al. | |

FOREIGN PATENT DOCUMENTS

| | | |
|---|---|---|
| JP | 2000-293136 | 10/2000 |
| JP | 2001-255848 | 9/2001 |
| JP | 2003-043989 | 2/2003 |

OTHER PUBLICATIONS

English language Abstract of JP 2001-255848.
English language Abstract of JP 11-095717.
English language Abstract of JP 11-327503.
English language Abstract of JP 2000-293136.
U.S. Appl. No. 11/817,354 to Arai et al., filed Aug. 29, 2007.

* cited by examiner

*Fig.6*

| | SETUP PERIOD TI | | WRITING PERIOD TW | | | | SUSTAIN PERIOD TU | |
|---|---|---|---|---|---|---|---|---|
| ST | ST1 | ST2 | ST3 | ST4 | ST5 | ST6 | ST7 | ST8 |
| SWb | — | | ON | | — | | ON | OFF |
| SWc | OFF | — | ON | | — | | ON | |
| SWd | ON | — | OFF | | — | | OFF | |
| SW1 | ON | OFF | OFF | | | | ON | |
| SW2 | ON | OFF | ON | | OFF | | ON | |
| SWI2 | OFF | ON | OFF | | ON | | OFF | |
| SWi | OFF | ON | OFF | | | | OFF | |
| SWj | OFF | | ON | | | | OFF | |
| SWh1 | ON | | OFF | ON | OFF | | ON | |
| SWh2 | ON | | OFF | | OFF | ON | ON | |
| SWf | ON | OFF | OFF | | | | OFF | ON |
| Esu2 | — | Ve | Ve | | | | Vsu | — |
| VCg1 | FROM Vst1 TO Vst | FROM Vad1 TO Vad | Vnd | Vad | Vnd | | 0 | Vsu |
| VCg2 | FROM Vst1 TO Vst | FROM Vad1 TO Vad | Vpa | | Vnd | Vad | 0 | Vsu |
| VU | 0 | Ve | Ve | | | | Vsu | 0 |

PLASMA DISPLAY PANEL DRIVE CIRCUIT AND PLASMA DISPLAY DEVICE

BACKGROUND OF THE INVENTION

1. Field of Invention

The present invention relates to technology for the drive circuit of a plasma display device for use in a wall-hanging television set or a large monitor, more particularly, to a plasma display panel drive circuit and a plasma display device.

2. Description of Related Art

An alternating current surface discharge plasma display panel (hereafter referred to as "PDP") being typical as an AC-type comprises a front panel formed of a glass substrate on which scan electrodes and sustain electrodes for carrying out surface discharge are arranged and a rear panel formed of a glass substrate on which data electrodes are arranged. The scan electrodes and the sustain electrodes are disposed in parallel so as to be opposed to the data electrodes, and the scan electrodes, the sustain electrodes and the data electrodes are arranged so as to construct a matrix and to form a discharge space in the clearance. The outer circumferential portions of the panels are sealed with a sealing agent, such as glass frit. Furthermore, discharge cells partitioned by partition walls are provided between both the substrates of the front panel and the rear panel, and phosphor layers are formed in the cell spaces between the partition walls. In the PDP configured as described above, ultraviolet light is generated by gas discharge, and the ultraviolet light excites the red (R), green (G) and black (B) phosphors to emit light for color display.

In this kind of plasma display device, the charging characteristics inside the panel depend on the ambient temperature of the panel, and differences occur in the charged state among the cells depend on the display pattern. Hence, the conventional drive method has a first problem that addressing errors (no discharge in addressed cells) due to excessive or insufficient charge in the inter-electrode space AY between the data electrodes A and the scan electrodes Y are apt to occur.

FIG. 14 shows the writing period of a sub-field. In addition, FIGS. 15A and 15B schematically show the states of the wall charges inside a cell at lines L1 and L2 shown in FIG. 14, respectively. The distribution of the wall charges in the discharge cell at line L1 shown in FIG. 14 is as shown in FIG. 15A. Since the state obtained immediately after the end of the setup period is shown in FIG. 15A, negative wall charges are accumulated sufficiently on the scan electrode SCN, and positive wall charges are accumulated sufficiently on the sustain electrode SUS and the data electrode DATA. On the other hand, the distribution of the wall charges in the discharge cell at line L2 shown in FIG. 14 is as shown in FIG. 15B, and the wall charges distributed on the respective electrodes are reduced in comparison with the state shown in FIG. 15A.

Priming particles floating in a discharge cell space due to setup or sustain discharge and electrons, etc. emitted from MgO activated due to sustain discharge are accelerated by the electric field inside a discharge cell waiting for writing. Hence, the wall charges accumulated by setup are neutralized gradually, and the wall charges on the respective electrodes are reduced as shown in FIG. 15B. If the writing operation is carried out in the state shown in FIG. 15A, discharge delay is decreased because the wall charges and the priming particles are sufficient, whereby favorable writing discharge is made possible. However, if the writing operation is carried out in the state shown in FIG. 15B, discharge delay is increased because both the wall charges and the priming particles are insufficient, whereby writing errors occur frequently and favorable picture quality cannot be obtained. This is a second problem.

To prevent the deterioration of picture quality due to the two problems described above, a method of weakening the electric field inside a discharge cell waiting for writing and suppressing the neutralization of wall charges is taken by raising the scan pulse voltage Vscn. FIG. 16 is a view showing an example of the relationship of the scan pulse voltage Vscn with respect to write-waiting time (the relationship being different depending on the drive method and the panel). The write-waiting time is herein a value represented by multiplying the number n of the scan electrode by the time for one scan pulse. The scan pulse voltage Vscn is higher as the ambient temperature becomes higher and as the write-waiting time becomes longer. Since the upper limit of the scan pulse voltage Vscn is determined by the withstand voltage of the drive circuit for use in the scan electrode drive circuit, such a drivable range as shown in FIG. 16 is present. As the resolution becomes higher to conform to the full high-vision, super high-vision (2 k×4 k), etc. in recent years, the write-waiting time increases abruptly, and the driving in the drivable range becomes difficult.

Accordingly, address drive methods have been disclosed to attain addressing that hardly causes errors even when the ambient temperature is high and to stabilize display without increasing the withstand voltage of the scan electrode drive circuit (for example, refer to the specification of U.S. Patent Application Publication No. 2001/0028225A1). The PDP drive device disclosed in the specification of U.S. Patent Application Publication No. 2001/0028225A1 has a scan electrode drive circuit and a sustain electrode drive circuit. The scan electrode drive circuit is provided with sustain pulse generating circuits, setup waveform generating circuits and scan pulse generating circuits, the numbers of which correspond to the number of panel divisions.

In the configuration described in the specification of U.S. Patent Application Publication No. 200110028225A1, multiple sustain pulse generating circuits and multiple setup waveform generating circuits are required. Hence, the number of components and the mounting areas of the components increase, and the cost required for the configuration increases. Furthermore, the configuration is applied to a case in which the panel is divided into two blocks and addressing is performed. If it is assumed that the panel is divided into n blocks, the results in that n pieces of sustain pulse generating circuits and n pieces of setup waveform generating circuits are required.

SUMMARY OF THE INVENTION

The present invention has been proposed to solve these problems and has an object described below. That is to say, an object of the present invention is to provide a PDP drive circuit and a plasma display device capable of performing addressing that hardly causes errors even when the ambient temperature is high without increasing the withstand voltage of the scan electrode drive circuit and also capable of reducing the amount of circuits.

To attain the above-mentioned object, the plasma display panel drive circuit according to the present invention, in a plasma display panel drive device in which multiple scan electrodes included in a plasma display panel is divided into at least first and second scan electrode groups, and a setup pulse is supplied in a setup period, scan pulses are supplied in a scan period and sustain pulses are supplied in a sustain period, comprises a first scan electrode group drive section, including a scan peak potential producing section to produce a predetermined peak potential, operable to produce scan pulses based on the scan peak potential and to supply the scan pulses to the first scan electrode group in a first sub-scan period within the scan period; a second scan electrode group drive section operable to produce scan pulses based on the scan peak potential of the scan peak potential producing section and supplying the scan pulses to the second scan electrode group in a second sub-scan period after the first sub-scan period within the scan period; and a complex switch section operable to supply the scan peak potential of the scan peak potential producing section to the second scan electrode group drive section in the second sub-scan period.

Furthermore, the plasma display device according to the present invention comprises a plasma display panel having scan electrodes, sustain electrodes and data electrodes, discharge cells being formed at the intersection portions of the scan electrodes, the sustain electrodes and the data electrodes; and the above-mentioned plasma display panel drive circuit operable to drive the plasma display panel.

The plasma display panel drive circuit and the plasma display device according to the present invention can attain addressing that is scarcely affected by the change in operation environment without increasing the withstand voltages of circuit components. Even when different voltages are applied to multiple regions at the time of non-selection addressing, the drive circuit can be configured using fewer number of components. Hence, it is possible to provide a PDP drive circuit and a plasma display device having a reduced installation area and fewer signals required for driving.

BRIEF DESCRIPTION OF THE DRAWINGS

FIG. 6 is a table showing the relationship among the operations of the switches in the PDP drive circuit according to Embodiment 1 of the present invention;

DETAILED DESCRIPTION OF THE PREFERRED EMBODIMENTS

Figure 1:
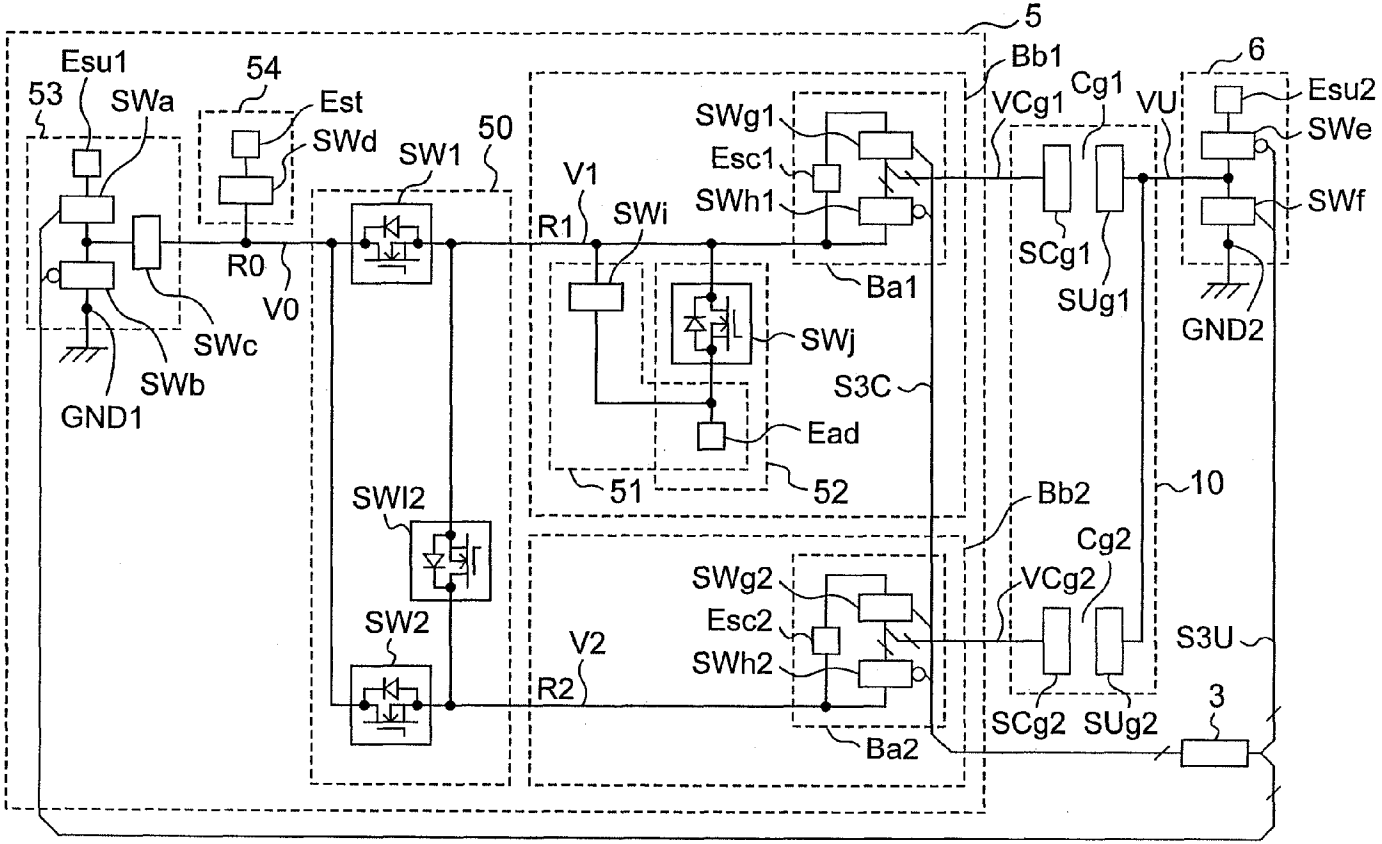
FIG. 1 is a block diagram showing the configuration of a PDP drive circuit according to Embodiment 1 of the present invention.

Some examples relating to embodiments according to the present invention will be described below referring to the drawings. Components having the substantially same configurations, operations and effects are designated by the same reference letters or numerals in the drawings. In addition, the numeric figures used in the following description are all provided as examples to specifically describe the present invention, and the present invention is not limited by the numeric figures provided as the examples. Similarly, the logic levels represented by high, low, on and off are provided as examples to specifically describe the present invention, and the present invention is not limited by the logic levels provided as the examples. Furthermore, the connection relationships among the components are provided as examples to specifically describe the present invention, and the connection relationships for attaining the functions of the present invention are not limited by the relationships provided as the examples.

Embodiment 1

1-1 General Description of a PDP Device

FIG. 1 is a block diagram showing the configuration of a plasma display panel (hereafter referred to as "PDP") drive circuit according to Embodiment 1 of the present invention. The PDP drive circuit shown in FIG. 1 is a circuit for driving the PDP by applying drive voltages to the electrodes of the PDP. The configuration and operation of the PDP will be described below before the detailed description of the configuration and operation of the PDP drive circuit.

1-1-1 Structure of the PDP

Figure 2:
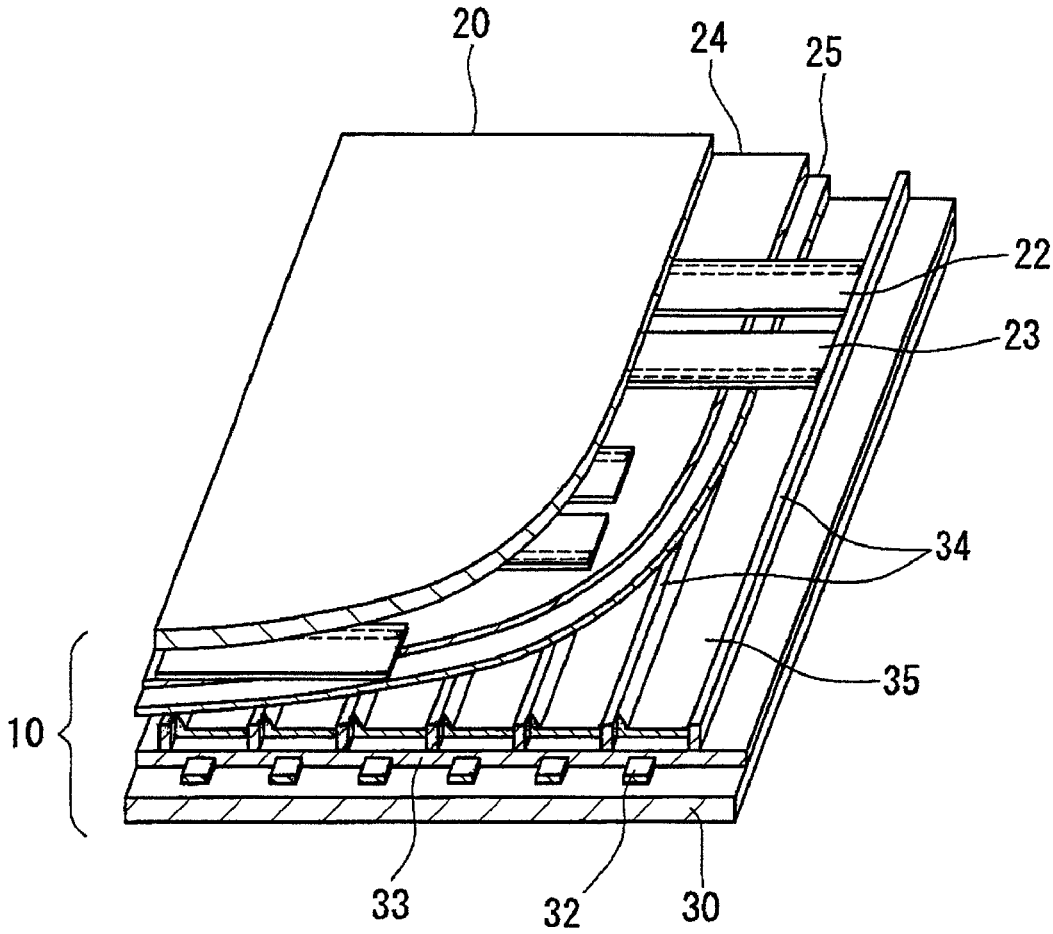
FIG. 2 is a perspective view showing the structure of a PDP.

FIG. 2 is a perspective view showing the structure of the PDP. On a front panel 20 made of glass, multiple display electrodes, each consisting of a pair of a stripe-shaped scan electrode 22 and a stripe-shaped sustain electrode 23, are formed. Furthermore, a dielectric layer 24 is formed so as to cover the scan electrodes 22 and the sustain electrodes 23, and a protection layer 25 is formed on the dielectric layer 24.

On a rear panel 30, multiple stripe-shaped data electrodes 32 covered with a dielectric layer 33 are formed so as to three-dimensionally intersect the scan electrodes 22 and the sustain electrodes 23. Multiple partition walls 34 are disposed in parallel with the data electrodes 32 on the dielectric layer 33, and a phosphor layer 35 is provided between the partition walls 34 on the dielectric layer 33. In addition, the data electrodes 32 are each disposed between the partition walls 34 adjacent to each other.

The front panel 20 and the rear panel 30 are disposed so as to be opposed to each other with a minute discharge space held therebetween so that the scan electrodes and the sustain electrodes are orthogonal to the data electrodes. The outer circumferential portions of the panels are sealed with a sealing agent, such as glass frit. A mixture gas containing neon (Ne) and xenon (Xe), for example, is sealed as a discharge gas in the discharge space. The partial pressure of the xenon in the discharge gas is 7% or more. The discharge space is divided into multiple segments using the partition walls 34, and the phosphor layers 35 emitting the red (R), green (G) and blue (B) colors of light are disposed sequentially in the respective segments. Furthermore, discharge cells are formed at the portions in which the scan electrodes 22 and the sustain electrodes 23 intersect the data electrodes 32, and one pixel is formed of three discharge cells adjacent to one another in which the phosphor layers 35 emitting the respective colors of light are formed. The region in which the discharge cells constituting the pixels are formed serves as an image display region, and the circumference of the image display region, such as the region in which the glass frit is formed, serves as a non-display region in which images are not displayed.

1-1-2 PDP Electrode Arrangement

Figure 3:
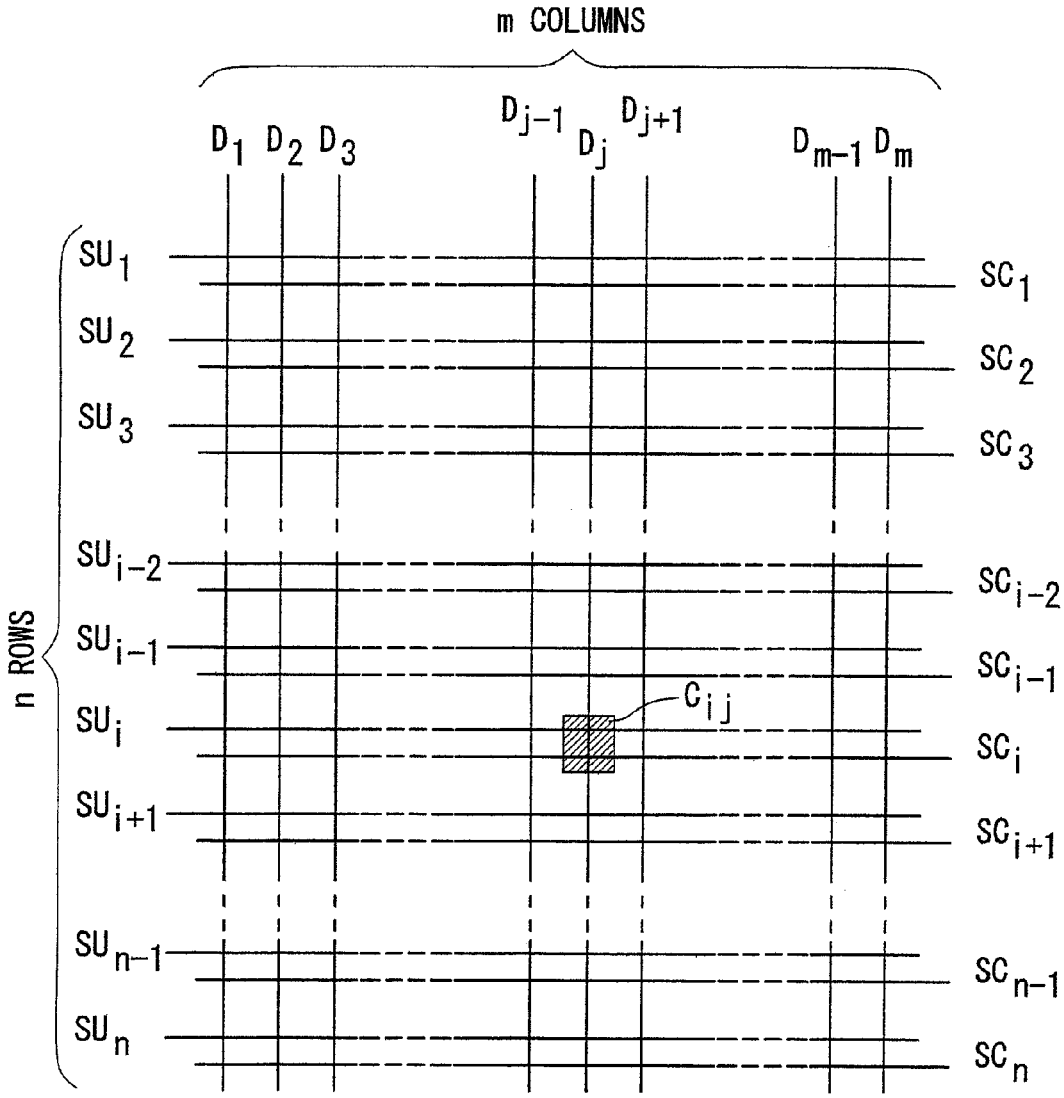
FIG. 3 is an explanatory view showing the arrangement of the electrodes of the PDP.

FIG. 3 is an explanatory view showing the arrangement of the electrodes of a PDP 10. Referring to the figure, n rows of scan electrodes SC1 to SCn and n rows of sustain electrodes SU1 to SUn are arranged alternately in the row direction, and m columns of data electrodes D1 to Dm are arranged in the column direction. In the figure, the n rows of the scan electrodes SC1 to SCn correspond to the scan electrodes 22 shown in FIG. 2, and each scan electrode is hereafter abbreviated to a "scan electrode SCi" (i=1 to n). In addition, n rows of the sustain electrodes SU1 to SUn correspond to the sustain electrodes 23 shown in FIG. 2, and each sustain electrode is hereafter abbreviated to a "sustain electrode SUi" (i=1 to n). Furthermore, the m columns of the data electrodes D1 to Dm correspond to the data electrodes 32 shown in FIG. 2, and each data electrode is hereafter abbreviated to a "data electrode Dj" (j=1 to m). Hence, discharge cells Cij, (n×m) pieces in total, each discharge cell including a pair of scan electrode SCi and sustain electrode SUi and one data electrode Dj, are formed inside the discharge space. One pixel is formed of three discharge cells emitting the red, green and blue colors of light. The PDP 10 according to Embodiment 1 is particularly effective when it is formed of one million or more pixels. However, even if it is formed of less than one million pixels, a certain effect is obtained.

In the PDP 10 configured as described above, ultraviolet light is generated by gas discharge, and the ultraviolet light excites the R, G and B phosphors to emit light for color display. Furthermore, in the PDP 10, one field is divided into multiple sub-fields and gradation is displayed by carrying out driving according to the combination of the sub-fields wherein light is emitted. Each sub-field consists of a setup period, a writing period and a sustain period, and signals having waveforms being different in the setup period, the writing period and the sustain period are applied to the respective electrodes to display image data.

1-1-3 PDP Drive Voltage Waveform

Figure 4:
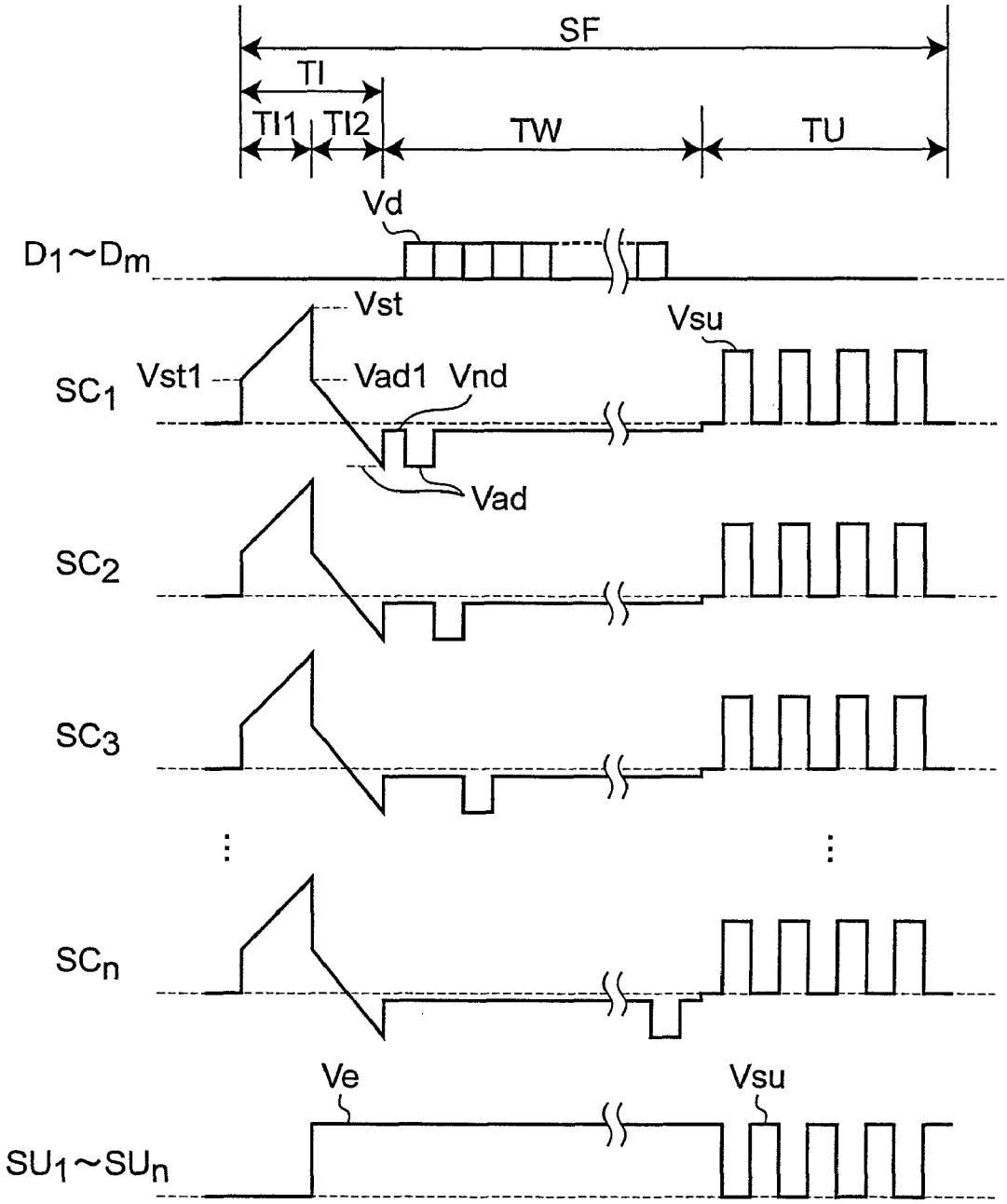
FIG. 4 is a waveform diagram showing the waveforms of the drive voltages applied to the respective electrodes of the PDP.

FIG. 4 is a waveform diagram showing the waveforms of the respective drive voltages applied to the respective electrodes of the PDP 10. As shown in FIG. 4, each sub-field SF has a setup period TI, a writing period TW and a sustain period TU. In addition, the operations in the respective sub-fields SF are almost the same, except that the number of sustain pulses in the sustain period TU is made different to change the weight of the light emitting period. Furthermore, the operation principles in the respective sub-fields SF are almost the same. Hence, the operation of only one sub-field SF will be described herein.

First, in the setup period TI, a positive setup pulse for initializing the discharge states of the discharge cells is applied to all the scan electrodes SCi. Hence, necessary wall charges are accumulated on the protection layer 25 and the phosphor layers 35 on the dielectric layer 24 covering the scan electrodes SCi and the sustain electrodes SUi. In addition, the setup pulse has a function of generating priming particles (an initiating agent for discharge, also referred to as exciting particles) to reduce discharge delay and to stably generate writing discharge.

More specifically, in a sub-setup period TI1 representing the first half of the setup period TI, the data electrodes Dj and the sustain electrodes SUi are held at 0 (V). An inclined waveform voltage gradually rising from a positive-direction setup start potential Vst1 less than the positive discharge start potential to a setup peak potential Vst exceeding the positive discharge start potential with respect to the data electrode Dj is applied to the scan electrode SCi. While this inclined waveform voltage rises, first weak setup discharge occurs among the scan electrode SCi, the sustain electrode SUi and the data electrode Dj. At the same time when a negative wall voltage is accumulated in the upper portion of the scan electrode SCi, positive wall voltages are accumulated in the upper portion of the data electrode Dj and the upper portion of the sustain electrode SUi. The wall voltage in the upper portion of each electrode herein represents a voltage generated by the wall charges accumulated on the dielectric layer covering the electrode. Furthermore, the setup peak potential Vst represents the potential of the setup pulse at the time when the absolute value of the setup pulse becomes maximum, that is, the potential of the setup pulse at the time when the absolute value of the potential difference between the potential of the setup pulse and the ground potential becomes maximum.

In the sub-setup period TI2 representing the latter half of the setup period TI, the sustain electrodes SUi are held at a predetermined positive sustain electrode offset potential Ve. At the same time, an inclined waveform voltage gradually lowering from a negative-direction setup start potential Vad1 less than the positive discharge start potential to a scan peak potential Vad exceeding the negative discharge start potential with respect to the sustain electrode SUi is applied to the scan electrode SCi. In this period, second weak setup discharge occurs among the scan electrode SCi, the sustain electrode SUi and the data electrode Dj. As a result, the negative wall voltage in the upper portion of the scan electrode SCi and the positive wall voltage in the upper portion of the sustain electrode SUi are weakened, and the positive wall voltage in the upper portion of the data electrode. Dj is adjusted to a value suited for writing operation. With the procedure described above, the setup operation is completed (hereafter, the drive voltage waveforms applied to the respective electrodes in the setup period TI are abbreviated to "setup waveforms"). The scan peak potential Vad is opposite in polarity to the setup peak potential Vst and has an absolute value smaller than that of the setup peak potential Vst.

Next, in the writing period TW after the setup period TI, writing discharge occurs in specific discharge cells Cpq among the (n×m) pieces of discharge cells Cij arranged in n rows and m columns based on a video signal. Herein, p represents a specific p-th row (p: 1 to n), q represents a specific q-th column (q: 1 to m), and the number of the discharge cells Cpq is in the range of 0 to (n×m) pieces. Hence, scanning is carried out by sequentially applying a scan pulse having the negative scan peak potential Vad to all the scan electrodes SCi.

More specifically, in the writing period TW, first, all the scan electrodes SCi are held once at a predetermined scan reference potential Vnd in preparation for supplying the scan pulse. Next, in the writing operation in the discharge cells Cpq, the scan pulse having the scan peak potential Vad is applied to the scan electrode SCp. At the same time, a data pulse having a positive data peak potential Vd is applied to the data electrode Dq to be displayed on the p-th row among the m columns of the data electrodes Dj. As a result, writing discharge occurs in the discharge cell Cpq corresponding to the intersection of the data electrode Dq to which the data peak potential Vd was applied and the scan electrode SCp to which the scan peak potential Vad was applied. By this writing discharge, a positive voltage is accumulated in the upper portion of the scan electrode SCp of the discharge cell Cpq, and a negative voltage is accumulated in the upper portion of the sustain electrode SUp, and the writing operation is completed. Hereafter, a similar writing operation is carried out to the discharge cell Cnq on the n-th row, and the writing operation is completed.

In the sustain period TU after the writing period TW, sustain pulses having a sustain peak potential Vsu being sufficient to maintain the discharge state are applied between the scan electrode SCi and the sustain electrode SUi for a predetermined period. As a result, discharge plasma is produced between the scan electrode SCi and the sustain electrode SUi, and the phosphor layer is excited to emit light for a predetermined period. At this time, in the discharge spaces other than the discharge cell Cpq in which the writing discharge occurred in the writing period TW, discharge does not occur and the excitation and light emission of the phosphor layer 35 do not occur.

More specifically, in the sustain period TU, after the scan electrode SCi is first returned to 0 (V) once, the sustain electrode SUi is returned to 0 (V). Then, the sustain pulses having the positive sustain peak potential Vsu are applied to the scan electrode SCi. At this time, a voltage is generated between the upper portion of the scan electrode SCp and the upper portion of the sustain electrode SUp in the discharge cell Cpq in which writing discharge occurred. This voltage includes the positive sustain pulse voltage Vsu and the sum value of the wall voltages accumulated in the upper portion of the scan electrode SCp and in the upper portion of the sustain electrode SUp in the writing period TW. As a result, the voltage between the wall voltages of both the electrodes becomes higher than the discharge start voltage, and a first sustain discharge occurs. Furthermore, in the discharge cell Cpq in which the sustain discharge occurred, a negative voltage is accumulated in the upper portion of the scan electrode SCp and a positive voltage is accumulated in the upper portion of the sustain electrode SUp such that the potential difference between the scan electrode SCp and the sustain electrode SUp at the time of the occurrence of the sustain discharge is canceled. With the procedure described above, the first sustain discharge is completed After the first sustain discharge, the scan electrode SCi is returned to 0 (V), and the positive sustain pulse voltage Vsu is applied to the sustain electrode SUi. At this time, a voltage is generated between the upper portion of the scan electrode SCp and the upper portion of the sustain electrode SUp in the discharge cell Cpq in which the first sustain discharge occurred. This voltage includes the positive sustain pulse voltage Vsu and the sum value of the wall voltages accumulated in the upper portion of the scan electrode SCp and in the upper portion of the sustain electrode SUp in the first sustain discharge. As a result, the voltage between the wall voltages of both the electrodes becomes higher than the discharge start voltage, and a second sustain discharge occurs. Hereafter, similarly, the sustain discharge is carried out continuously by the number of the sustain pulses for the discharge cell Cpq in which the writing discharge occurred by alternately applying the sustain pulse to the scan electrode SCi and the sustain electrode SUi.

1-1-4 Plasma Display Device

Figure 5:
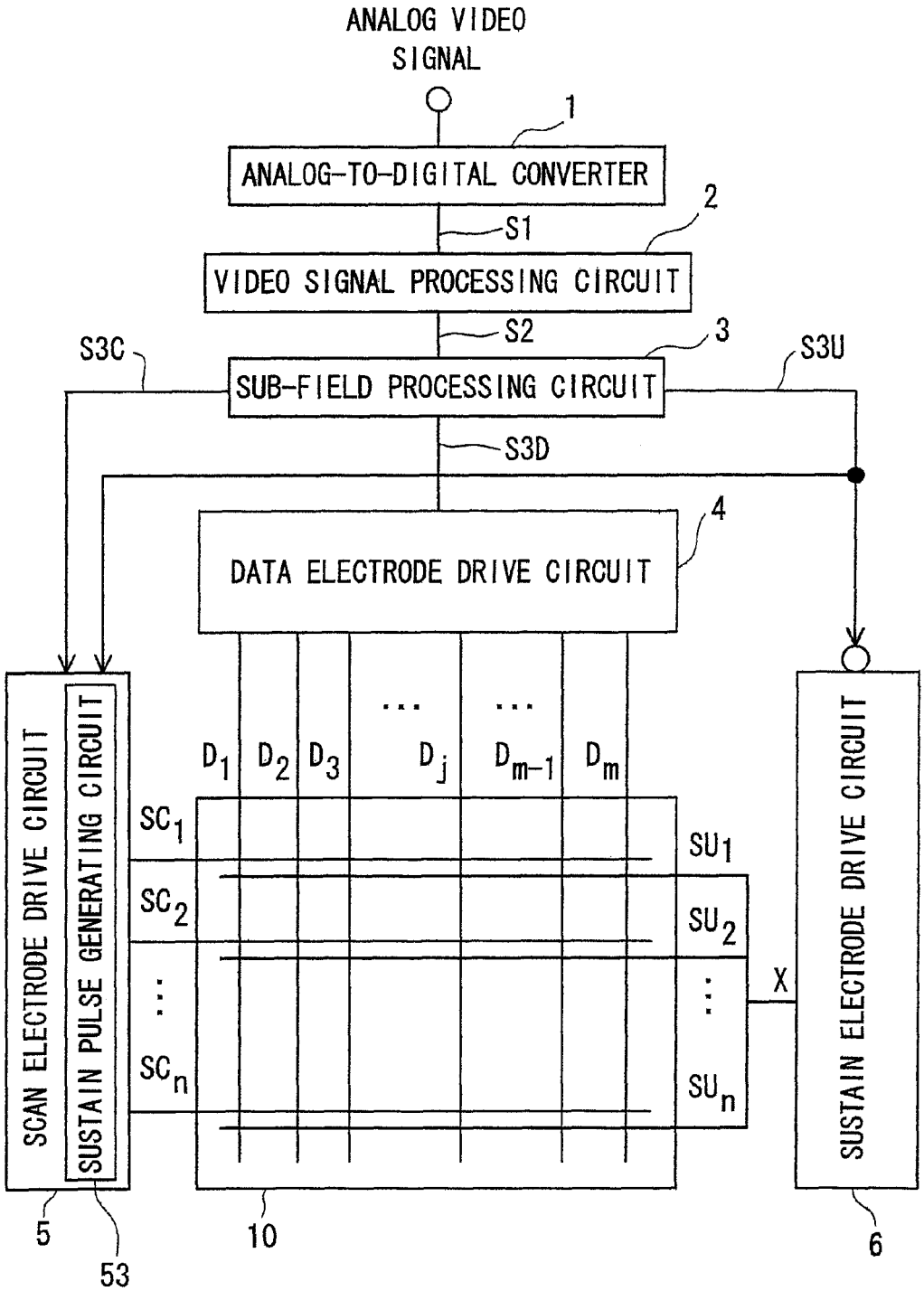
FIG. 5 is a block diagram showing the configuration of a plasma display device incorporating the PDP drive circuit according to Embodiment 1 of the present invention.

FIG. 5 is a block diagram showing the configuration of a plasma display device incorporating the PDP drive circuit according to Embodiment 1. The plasma display device shown in FIG. 5 comprises an Analog-to-Digital converter 1, a video signal processing circuit 2, a sub-field processing circuit 3, a data electrode drive circuit 4, a scan electrode drive circuit 5, a sustain electrode drive circuit 6 and the PDP 10.

The Analog-to-Digital converter 1 converts an input analog video signal into a digital video signal S1. The video signal processing circuit 2 processes the input digital video signal S1 so as to be displayed by light emission on the PDP 10 according to the combination of multiple sub-fields SF being different in the weight of the light emission period. For this purpose, the video signal processing circuit 2 converts one field of the video signal into sub-field data S2 for controlling each sub-field SF.

The sub-field processing circuit 3 produces a data electrode drive circuit control signal S3D, a scan electrode drive circuit control signal S3C and a sustain electrode drive circuit control signal S3U from the sub-field data S2 created using the video signal processing circuit 2. The data electrode drive circuit control signal S3D is supplied to the data electrode drive circuit 4. Furthermore, the scan electrode drive circuit control signal S3C is supplied to the scan electrode drive circuit 5, and the sustain electrode drive circuit control signal S3U is supplied to the sustain electrode drive circuit 6 and the scan electrode drive circuit 5.

The data electrode drive circuit 4 independently drives the respective data electrodes Dj based on the data electrode drive circuit control signal S3D. The scan electrode drive circuit 5 incorporates a sustain pulse producing circuit 53 for producing sustain pulses applied to the scan electrode SCi in the sustain period TU and can collectively drive the respective scan electrodes SCi based on the sustain electrode drive circuit control signal S3U. In addition, the scan electrode drive circuit 5 independently drives the respective scan electrodes SCi based on the scan electrode drive circuit control signal S3C. The sustain electrode drive circuit 6 is provided with a circuit for producing sustain pulses applied to the sustain electrodes SUi in the sustain period TU and can collectively drive all the sustain electrodes SUi of the PDP 10. Hence, the sustain electrode drive circuit 6 drives the sustain electrodes SUi based on the sustain electrode drive circuit control signal S3U.

1-2 Configuration and Operation of the PDP Drive Circuit

Figure 7:
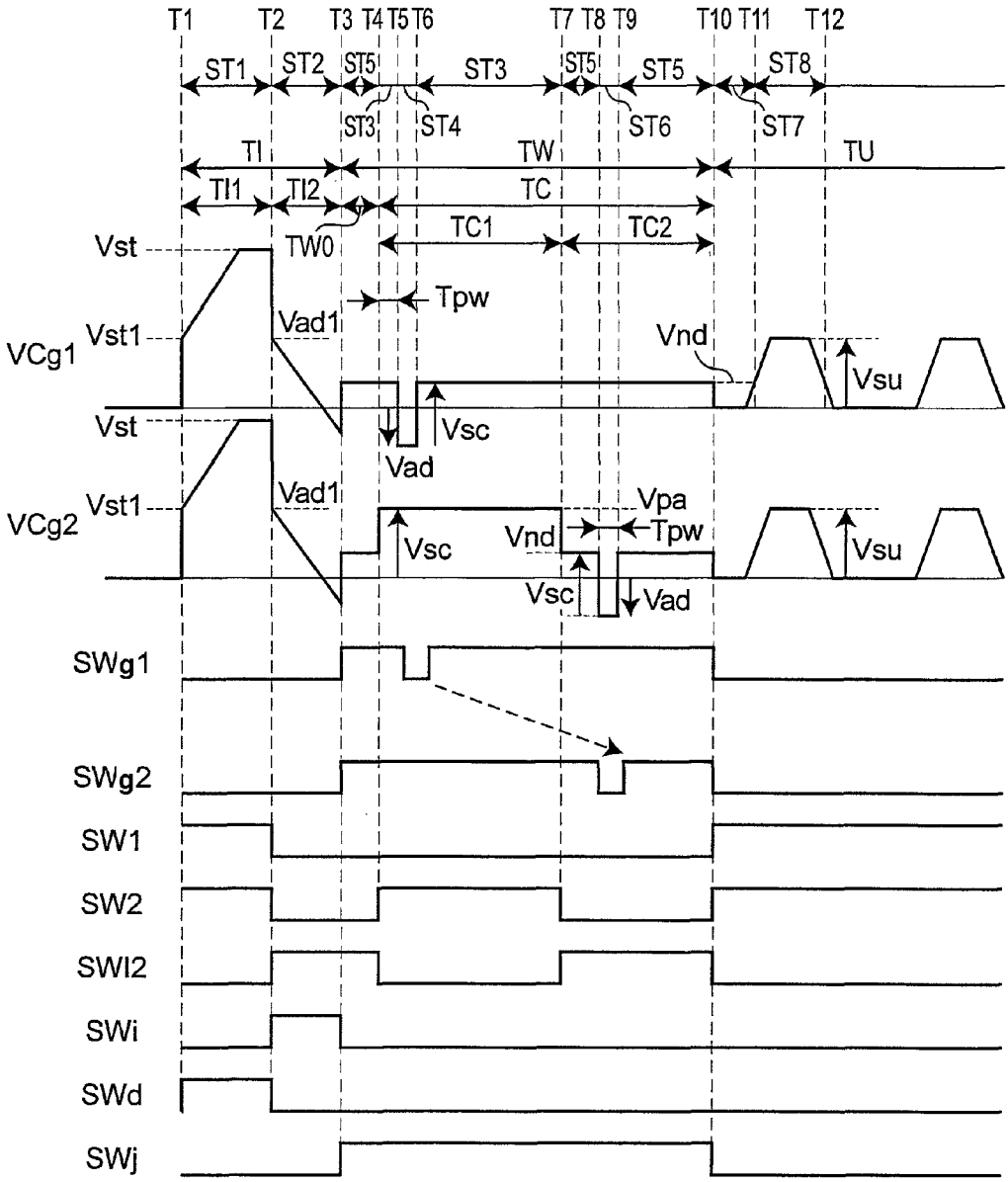
FIG. 7 is a waveform diagram showing the waveforms of the drive voltages in the PDP drive circuit according to Embodiment 1 of the present invention.

The configuration and operation of the PDP drive circuit will be described below referring to FIGS. 1, 4, 6 and 7. FIG. 6 is a table showing the relationship among the operations of the respective switch sections included in the PDP drive circuit shown in FIG. 1. FIG. 7 is a waveform diagram showing the waveforms of the drive voltages applied in the setup period TI, the writing period TW and the sustain period TU, FIG. 7 being related to FIG. 4. The on/off states of the respective switches shown in FIG. 6 are controlled using the sub-field processing circuit 3. However, wires are not shown in FIG. 1 for simplicity. The sub-field processing circuit 3 comprises logic circuits, a microcomputer or a combination of both and controls the respective switch sections according to the following description referring to FIGS. 1, 4, 6 and 7.

1-2-1 General Description of the PDP Drive Circuit

FIG. 1 is a block diagram showing part of the plasma display device according to Embodiment 1 shown in FIG. 5, including the sub-field processing circuit 3, the scan electrode drive circuit 5, the sustain electrode drive circuit 6 and the PDP 10. The PDP drive circuit according to Embodiment 1 is provided with a two-group division drive configuration (two-group configuration) in which the total number of the scan electrodes is divided into two groups and the two groups are driven separately. The scan electrodes SCi, n pieces in total, are divided into a scan electrode group SCg1 including n1 pieces of scan electrodes for the scanning in the first half period of the writing period TW and a scan electrode group SCg2 including n2 pieces of scan electrodes for the scanning in the latter half period thereof. Herein, n1 is an integer equal to or larger than 1 and smaller than n, and n2 is an integer equal to or larger than 1 and smaller than n. Similarly, the sustain electrodes SUi, n pieces in total, are divided into a sustain electrode group SUg1 including n1 pieces of sustain electrodes and a sustain electrode group SUg2 including n2 pieces of sustain electrodes. The n1 pieces of the sustain electrodes in the sustain electrode group SUg1 and the n1 pieces of the scan electrodes in the scan electrode group SCg1 form pairs respectively. The n2 pieces of the sustain electrodes in the sustain electrode group SUg2 and the n2 pieces of the scan electrodes in the scan electrode group SCg2 form pairs respectively. It is noted that n1+n2=n. Usually, n is nearly equally divided into n1 and n2; however, it may be divided unequally. The PDP drive circuit according to Embodiment 1 drives totally n pieces of the scan electrodes that are divided into the scan electrode group SCg1 and the scan electrode group SCg2, and supplies the setup, scan and sustain pulses.

The discharge cell Cij is formed of the scan electrode SCi, the sustain electrode SUi and the data electrode Dj. In the following description, the data electrode Dj is set to a data electrode Dj having a specific subscript "j". Hence, the number of the discharge cells Cij is n, and the subscript "j" is omitted from the respective discharge cells. The results obtained in this way holds true for the data electrodes and the discharge cells other than those having the specific subscript "j" as a matter of course. In other words, n pieces of the discharge cells Cij include the discharge cell group Cg1 formed of the scan electrode group SCg1 and the sustain electrode group SUg1 and the discharge cell group Cg2 formed of the scan electrode group SCg2 and the sustain electrode group SUg2.

The scan electrode drive circuit 5 and the sustain electrode drive circuit 6 each have one or more switch sections as described later. The switch section includes a semiconductor device having a switching function, such as a MOS transistor, a bipolar transistor or an IGBT (insulated gate bipolar transistor). These various kinds of switching devices are used in plural or combined variously depending on cases. In particular, multiple pieces are used in parallel to provide the required amount of output current.

The scan electrode drive circuit 5 comprises the sustain pulse generating circuit 53, a positive setup waveform producing circuit 54, a complex switch section 50, a scan electrode group drive section Bb1 and a scan electrode group drive section Bb2. The sustain pulse generating circuit 53 is also referred to as a sustain pulse producing circuit. The positive setup waveform producing circuit 54 is also referred to as a positive setup section. The sustain pulse generating circuit 53, the positive setup waveform producing circuit 54 and one terminal of the complex switch section 50 are connected to a common discharge route R0. Another terminal of the complex switch section 50 is connected to one terminal of the scan electrode group drive section Bb1 via a discharge route R1, and the other terminal thereof is connected to one terminal of the scan electrode group drive section Bb2 via a discharge route R2. Other terminals of the scan electrode group drive section Bb1 are connected to the n1 pieces of the scan electrodes in the scan electrode group SCg1 via separate wires. Other terminals of the scan electrode group drive section Bb2 are connected to the n2 pieces of the scan electrodes in the scan electrode group SCg2 via separate wires. On the other hand, one terminal of the sustain electrode drive circuit 6 is connected to totally n pieces of the sustain electrodes in the sustain electrode groups SUg1 and SUg2 via a single wire.

1-2-2 Sustain Pulse Generating Circuit 53

The sustain pulse generating circuit 53 comprises a sustain pulse voltage supply Esu1, a high-potential side switch section SWa, a low-potential side switch section SWb and a switch section SWc. The sustain pulse voltage supply Esu1 supplies the predetermined positive sustain pulse voltage Vsu. One terminal of the high-potential side switch section SWa is connected to the sustain pulse voltage supply Esu1. The low-potential side switch section SWb is inserted between the other terminal of the high-potential side switch section SWa and a ground terminal GND1. The switch section SWc is inserted between the connection point of the high-potential side switch section SWa and the low-potential side switch section SWb and the common discharge route R0. The potential level of the sustain pulse voltage Vsu with respect to the ground potential represents the peak potential of the sustain pulses and is also referred to as the sustain peak potential Vsu. In Embodiment 1, the sustain peak potential Vsu is a positive potential. The sustain pulse generating circuit 53 alternately turns on the high-potential side switch section SWa and the low-potential side switch section SWb based on the sustain electrode drive circuit control signal S3U from the sub-field processing circuit 3. As a result, the sustain pulse generating circuit 53 generates sustain pulses specified using the sustain pulse potential Vsu and the ground potential.

1-2-3 Positive Setup Waveform Producing Circuit 54

The positive setup waveform producing circuit 54 comprises a positive setup pulse voltage supply Est for supplying the predetermined positive setup pulse voltage Vst and a switch section SWd, one terminal of which is connected to the positive setup pulse voltage supply Est and the other terminal of which is connected to the common discharge route R0. The potential level of the positive setup pulse voltage Vst with respect to the ground potential represents the peak potential of the setup pulse and is also referred to as the positive setup peak potential Vst. In Embodiment 1, the positive setup peak potential Vst is a positive potential.

The switch section SWd produces a positive-direction setup start voltage Vst1 based on the positive setup peak potential Vst. When the switch section SWd turns on, the positive setup waveform producing circuit 54 first sets the common discharge route R0 to the positive-direction setup start voltage Vst1. Next, the positive setup waveform producing circuit 54 produces a setup pulse rising monotonically and gradually from the positive-direction setup start voltage Vst1 to the positive setup peak potential Vst as shown in FIG. 7. This kind of setup pulse waveform is produced, for example, by increasing the ON resistance of the switch section SWd. In the case that the positive-direction setup start voltage Vst1 is equal to the sustain voltage Vsu, the potential of the common discharge route R0 may be set to the sustain peak potential Vsu by turning on the switch section SWa of the sustain pulse generating circuit 53. In the setup period TI, the period during which the positive setup waveform producing circuit 54 produces the setup pulse is also referred to as a positive sub-setup period TI1 (shown in FIG. 7). The setup pulse in the positive sub-setup period TI1 is also referred to as a positive sub-setup pulse.

In the positive sub-setup period TI1 during which the positive setup waveform producing circuit 54 produces the setup pulse, the switch section SWd is turned on, but the switch section SWc is turned off, whereby the sustain pulse generating circuit 53 is separated from the common discharge route R0. On the other hand, in the sustain period TU during which the sustain pulse producing circuit 53 produces the sustain pulses, the switch section SWc is turned on, but the switch section SWd is turned off, whereby the positive setup waveform producing circuit 54 is separated from the common discharge route R0. The signal in the common discharge route R0 is also referred to as a common discharge route potential V0. In the sustain period TU, the common discharge route potential V0 serves as the sustain pulse, and in the positive sub-setup period TI1, the common discharge route potential V0 serves as the setup pulse.

1-2-4 Complex Switch Section 50

The complex switch section 50 comprises a group switch section SW1, a group switch section SW2 and an inter-group switch section SWI2. The drain terminal of the group switch section SW1 is connected to the common discharge route R0, and the source terminal thereof is connected to the scan electrode group drive section Bb1 via the discharge route R1, whereby the connection between the common discharge route R0 and the scan electrode group drive section Bb1 is turned on/off. The drain terminal of the group switch section SW2 is connected to the common discharge route R0, and the source terminal thereof is connected to the scan electrode group drive section Bb2 via the discharge route R2, whereby the connection between the common discharge route R0 and the scan electrode group drive section Bb2 is turned on/off.

In the two-group configuration according to Embodiment 1, the group switch section SW1 and the scan electrode group drive section Bb1 constitute a first group sub-scan electrode drive circuit, and the group switch section SW2, the inter-group switch section SWI2 and the scan electrode group drive section Bb2 constitute a second group sub-scan electrode drive circuit. The scan electrode drive circuit 5 comprises the sustain pulse generating circuit 53, the positive setup waveform producing circuit 54, the first group sub-scan electrode drive circuit and the second group sub-scan electrode drive circuit. The first group sub-scan electrode drive circuit is also referred to as a first group, and the second group sub-scan electrode drive circuit is also referred to as a second group The source terminal of the inter-group switch section SWI2 is connected to the discharge route R1, and the drain terminal thereof is connected to the discharge route R2, whereby the connection between the discharge route R1 and the discharge route R2 is turned on/off. The potential V1 of the discharge route R1 is also referred to as a discharge route potential V1. The potential V2 of the discharge route R2 is also referred to as a discharge route potential V2. The body diodes of the group switch section SW1 and the group switch section SW2 are disposed in the directions of shutting off the currents flowing from the ground terminal GND1 of the sustain pulse generating circuit 53 to the discharge route R1 and the discharge route R2, respectively. In addition, the body diode of the inter-group switch section SWI2 is disposed in the direction of shutting off the current flowing from the discharge route R2 to the discharge route R1. Switches, such as the group switch section SW1 and the group switch section SW2, for shutting off the currents flowing from the ground terminal GND1 to the discharge routes R1 and R2 are also referred to as Vad separation switches.

1-2-5 Scan Electrode Group Drive Section Bb1

The scan electrode group drive section Bb1 comprises a negative setup waveform producing circuit 51 connected to the discharge route R1, an address voltage applying circuit 52 also connected to the discharge route R1 and a scan section Ba1 inserted between the discharge route R1 and the scan electrode group SCg1. The negative setup waveform producing circuit 51 is also referred to as a negative setup section, and the address voltage applying circuit 52 is also referred to as a scan peak potential producing section.

The negative setup waveform producing circuit 51 comprises a scan pulse voltage supply Ead for supplying a predetermined negative scan pulse voltage Vad and a switch section SWi, one terminal of which is connected to the scan pulse voltage supply Ead and the other terminal of which is connected to the discharge route R1. The potential level of the scan pulse voltage Vad with respect to the ground potential represents the peak potential of the scan pulse, and the scan pulse voltage Vad is also referred to as a scan peak potential Vad or a selection potential Vad. In Embodiment 1, the scan peak potential Vad is a negative potential.

The switch section SWi produces the negative-direction setup start potential Vad1 based on the scan peak potential Vad. When the switch section SWi turns on, the negative setup waveform producing circuit 51 first sets the discharge route potential V1 to the negative-direction setup start potential Vad1. Furthermore, the negative setup waveform producing circuit 51 produces a setup pulse lowering monotonically and gradually from the negative-direction setup start voltage Vad1 to the scan peak potential Vad as shown in FIG. 7. This kind of setup pulse waveform is produced, for example, by increasing the ON resistance of the switch section SWi. In the case that the negative-direction setup start voltage Vad1 is equal to the sustain voltage Vsu, the potential of the common discharge route R0 may be set to the sustain peak potential Vsu by turning on the switch section SWa of the sustain pulse generating circuit 53. In the setup period TI, the period during which the negative setup waveform producing circuit 51 produces the setup pulse is also referred to as a negative sub-setup period TI2 (shown in FIG. 7). The setup pulse in the negative sub-setup period TI2 is also referred to as a negative sub-setup pulse.

The address voltage applying circuit 52 comprises the scan pulse voltage supply Ead and a switch section SWj, the source terminal of which is connected to the scan pulse voltage supply Ead and the drain terminal of which is connected to the discharge route R1. The body diode of the switch section SWj is disposed in the direction of shutting off the current flowing from the discharge route R1 to the scan pulse voltage supply Ead. The address voltage applying circuit 52 sets the discharge route potential V1 to the scan peak potential Vad by turning on the switch section SWj in the writing period TW.

The scan section Ba1 comprises a scan reference voltage supply Esc1, a high-potential side switch section group SWg1 and a low-potential side switch section group SWh1. The scan reference voltage supply Esc1 supplies a predetermined positive scan reference Vsc. One terminal of the high-potential side switch section group SWg1 is connected to one terminal of the scan reference voltage supply Esc1. The low-potential side switch section group SWh1 is inserted between other terminals of the high-potential side switch section group SWg1 and the discharge route R1. The high-potential side switch section group SWg1 and the low-potential side switch section group SWh1 are each provided with n1 pieces of switch sections corresponding to n1 pieces of scan electrodes within the scan electrode group SCg1, and the switch sections are respectively connected to the scan electrodes at n1 pieces of connection points. The n1 pieces of connection points are respectively connected to n1 pieces of scan electrodes within the scan electrode group SCg1, and n1 kinds of scan electrode group drive signals VCg1 are supplied to the scan electrode group SCg1.

On the other hand, the other terminal of the scan reference voltage supply Esc1 is connected to the discharge route R1 in parallel with the series connection of the high-potential side switch section group SWg1 and the low-potential side switch section group SWh1, and the scan reference voltage Vsc is applied to the series connection. The potential level at the connection point of the scan reference voltage supply Esc1 and the high-potential side switch section group SWg1 has a potential difference of the scan reference voltage Vsc in the direction of the positive setup peak potential Vst with respect to the discharge route potential V1 and is also referred to as a non-selection potential. The non-selection potential represents a potential other than the selection potential representing the scan peak potential Vad of the scan pulse in the writing period TW. In other words, the non-selection potential is represented by (V1+Vsc). The scan section Ba1 sets the scan electrode group drive signals VCg1 to the non-selection potential by turning on the high-potential side switch section group SWg1 and by turning off the low-potential side switch section group SWh1. Conversely, the scan section Ba1 sets the scan electrode group drive signals VCg1 to the discharge route potential V1 by turning off the high-potential side switch section group SWg1 and by turning on the low-potential side switch section group SWh1.

Since the discharge route potential V1 is set to the scan peak potential Vad in the writing period TW, the non-selection potential has a potential difference of the scan reference voltage Vsc in the direction of the positive setup peak potential Vst with respect to the scan peak potential Vad. In this case, the non-selection potential is also referred to as a scan reference potential Vnd. In other words, the scan reference potential Vnd is represented by (Vnd=Vad+Vsc). As shown in FIGS. 4 and 7, in Embodiment 1, the scan peak potential Vad is a negative potential, and the scan reference potential Vnd is negative in the case shown in FIG. 4 and positive in the case shown in FIG. 7. As shown in FIG. 7, the scan section Ba1 sets the scan electrode group drive signals VCg1 to the scan reference potential Vnd in the sub-scan period TC1 within the writing period TW by turning on the high-potential side switch section group SWg1 and by turning off the low-potential side switch section group SWh1. Conversely, the scan section Ba1 sets the scan electrode group drive signals VCg1 to the scan peak potential Vad by turning off the high-potential side switch section group SWg1 and by turning on the low-potential side switch section group SWh1. In other words, the scan section Ba1 produces a negative scan pulse. The scan reference potential Vnd has a potential difference of the scan reference voltage Vsc in the direction of the positive setup peak potential Vst with respect to the scan peak potential Vad. In this way, the scan electrode group drive section Bb1 according to Embodiment 1 drives the scan electrode group SCg1 and supplies the setup, scan and sustain pulses.

1-2-6 Scan Electrode Group Drive Section Bb2

The scan electrode group drive section Bb2 includes a scan section Ba2 inserted between the discharge route R2 and the scan electrode group SCg2. Functions similar to those of the negative setup waveform producing circuit 51 and the address voltage applying circuit 52 included in the scan electrode group drive section Bb1 are not included in the scan electrode group drive section Bb2.

The scan section Ba2 comprises a scan reference voltage supply Esc2, a high-potential side switch section group SWg2 and a low-potential side switch section group SWh2. The scan reference voltage supply Esc2 supplies a predetermined positive scan reference Vsc. One terminal of the high-potential side switch section group SWg2 is connected to one terminal of the scan reference voltage supply Esc2. The low-potential side switch section group SWh2 is inserted between other terminals of the high-potential side switch section group SWg2 and the discharge route R2. The high-potential side switch section group SWg2 and the low-potential side switch section group SWh2 are each provided with n2 pieces of switch sections corresponding to n2 pieces of scan electrodes within the scan electrode group SCg2, and the switch sections are respectively connected to the scan electrodes at n2 pieces of connection points. The n2 pieces of connection points are respectively connected to n2 pieces of scan electrodes within the scan electrode group SCg2, and n2 kinds of scan electrode group drive signals VCg2 are supplied to the scan electrode group SCg2.

On the other hand, the other terminal of the scan reference voltage supply Esc2 is connected to the discharge route R2 in parallel with the series connection of the high-potential side switch section group SWg2 and the low-potential side switch section group SWh2, and the scan reference voltage Vsc is applied to the series connection. The potential level at the connection point of the scan reference voltage supply Esc2 and the high-potential side switch section group SWg2 has a potential difference of the scan reference voltage Vsc in the direction of the positive setup peak potential Vst with respect to the discharge route potential V2 and is also referred to as a non-selection potential. In other words, the non-selection potential is represented by (V2+Vsc). The scan section Ba2 sets the scan electrode group drive signals VCg2 to the non-selection potential by turning on the high-potential side switch section group SWg2 and by turning off the low-potential side switch section group SWh2. Conversely, the scan section Ba2 sets the scan electrode group drive signals VCg2 to the discharge route potential V2 by turning off the high-potential side switch section group SWg2 and by turning on the low-potential side switch section group SWh2.

The discharge route potential V1 is set to the scan peak potential Vad in the sub-scan period TC2 within the writing period TW (shown in FIG. 7). Since the group switch section SW1 and the group switch section SW2 are turned off and the inter-group switch section SWI2 is turned on, the discharge route potential V2 is also set to the scan peak potential Vad. The non-selection potential has a potential difference of the scan reference Vsc in the direction of the positive setup peak potential Vst with respect to the scan peak potential Vad. In this case, the non-selection potential is also referred to as a scan reference potential Vnd. In other words, the scan reference potential Vnd is represented by (Vnd=Vad+Vsc). As shown in FIGS. 4 and 7, in Embodiment 1, the scan peak potential Vad is a negative potential, and the scan reference potential Vnd is negative in the case shown in FIG. 4 and positive in the case shown in FIG. 7. Like the scan section Ba1, the scan section Ba2 sets the scan electrode group drive signals VCg2 to the scan reference potential Vnd in the sub-scan period TC2 within the writing period TW by turning on the high-potential side switch section group SWg2 and by turning off the low-potential side switch section group SWh2. Conversely, the scan section Ba2 sets the scan electrode group drive signals VCg2 to the scan peak potential Vad by turning off the high-potential side switch section group SWg2 and by turning on the low-potential side switch section group SWh2. In other words, the scan section Ba2 produces a negative scan pulse. In this way, the scan electrode group drive section Bb2 according to Embodiment 1 drives the scan electrode group SCg2 and supplies the setup, scan and sustain pulses.

1-2-7 Sustain Electrode Drive Circuit 6

The sustain electrode drive circuit 6 comprises a sustain pulse voltage supply Esu2, a high-potential side switch section SWe and a low-potential side switch section SWf. The sustain pulse voltage supply Esu2 supplies the predetermined positive sustain pulse voltage Vsu in the sustain period TU and supplies the positive sustain electrode offset voltage Ve in the sub-setup period TI2 and the writing period TW. One terminal of the high-potential side switch section SWe is connected to the sustain pulse voltage supply Esu2. The low-potential side switch section SWf is inserted between the other terminal of the high-potential side switch section SWe and a ground terminal GND2. One connection point of the high-potential side switch section SWe and the low-potential side switch section SWf is connected to all the n1 pieces of the sustain electrodes within the sustain electrode group SUg1 and all the n2 pieces of the sustain electrodes within the sustain electrode group SUg2. Hence, the sustain electrode drive circuit 6 supplies one kind of sustain electrode drive signal VU to both the sustain electrode group SUg1 and the sustain electrode group SUg2.

The potential level of the sustain pulse voltage Vsu with respect to the ground potential represents the peak potential of the sustain pulses and is also referred to as the sustain peak potential Vsu. The potential level of the sustain electrode offset voltage Ve with respect to the ground potential is also referred to as a sustain electrode offset potential Ve. In Embodiment 1, both the sustain peak potential Vsu and the sustain electrode offset potential Ve are positive potentials. The sustain electrode drive circuit 6 alternately turns on the high-potential side switch section SWe and the low-potential side switch section SWf based on the sustain electrode drive circuit control signal S3U from the sub-field processing circuit 3 in the sustain period TU. As a result, the sustain electrode drive circuit 6 produces sustain pulses having a potential specified using the sustain pulse potential Vsu and the ground potential. As shown in FIG. 1, the sustain electrode drive circuit control signal S3U of the sustain electrode drive circuit 6 is inverted in comparison with the case of the sustain pulse generating circuit 53. For this reason, in the sustain period TU, the sustain electrode drive circuit 6 produces sustain pulses synchronized with and inverted from the sustain pulses of the sustain pulse generating circuit 53 (shown in FIG. 4) and supplies the sustain electrode drive signal VU representing the sustain pulses to the sustain electrode groups SUg1 and SUg2. Furthermore, in the sub-setup period 112 and the writing period TW, the sustain electrode drive circuit 6 produces the sustain electrode offset voltage Ve (shown in FIG. 4) by turning on the high-potential side switch section SWe and turned off the low-potential side switch section SWf.

The sub-field processing circuit 3 supplies n1 kinds of the scan electrode drive circuit control signal S3C to the scan section Ba1 and supplies n2 kinds of the scan electrode drive circuit control signal S3C to the scan section Ba2. Hence, in the setup period TI, the writing period TW and the sustain period TU, the sub-field processing circuit 3 controls the switch sections within the scan sections Ba1 and Ba2 and supplies the setup, scan and drive pulses to the respective scan electrode groups SCg1 and SCg2.

In particular, in the sub-scan period TC1, n1 pieces of the switch sections within the low-potential side switch section group SWh1 are turned on sequentially only in a scan pulse width period Tpw (shown in FIG. 7) representing the period of the width of a scan pulse. Next, in the sub-scan period TC2 after the sub-scan period TC1, n2 pieces of the switch sections within the low-potential side switch section group SWh2 are turned on sequentially only in the scan pulse width period Tpw. Hence, the scan electrode group drive signals VCg1 and VCg2 representing scan pulses can be supplied to the scan electrode groups SCg1 and SCg2 based on a single scan system for sequentially supplying a scan pulse to the respective scan electrodes.

As described above, after the sub-setup period TI2, the respective scan electrode group drive signals VCg1 and VCg2 according to Embodiment 1 are required to rise quickly from the scan peak potential Vad to the scan reference potential Vnd (see FIG. 4). Since the respective scan sections Ba1 and Ba2 are configured to select the scan peak potential Vad or the scan reference potential Vnd, the levels of the scan electrode group drive signals VCg1 and VCg2 change quickly between the two potentials. Although the scan reference potential Vnd is negative in FIG. 4, the scan reference potential Vnd can be made positive as shown in FIG. 7 by setting the scan reference voltage Vsc so as to be higher than the scan peak potential Vad.

1-3 Operation Sequence of the PDP Drive Circuit

The operation sequence of the PDP drive circuit will be described below referring to FIGS. 1, 6 and 7. FIG. 7 shows the operation waveforms of the respective components of the PDP drive circuit shown in FIG. 1. FIG. 6 shows the operation states ST of the respective components in the respective periods. The operation states ST represent the on/off states of the respective switches and the states of the potential levels of the respective signals. In the sustain pulse generating circuit 53, the scan electrode group drive section Bb1, the scan electrode group drive section Bb2 and the sustain electrode drive circuit 6, the high-potential side switch section and the low-potential side switch section are formed in pair and have logic states inverted with respect to each other. For this reason, the following description is given by particularly paying attention to the low-potential side switch section in FIGS. 6 and 7, and the description of the high-potential side switch section is omitted.

1-3-1 Sub-Setup Period TI1

The setup period TI includes the sub-setup period TI1 and the sub-setup period TI2. The sub-setup period TI1 is the period from time point T1 to time point T2, and the operation state ST in the period is the operation state ST1. The switch sections SWc, SWI2, SWi and SWj are turned off, and the switch sections SWd, SW1 and SW2 and the switch section groups SWh1 and SWh2 are turned on. Hence, the discharge routes R1 and R2 are separated from the sustain pulse generating circuit 53, the inter-group switch section SWI2, the negative setup waveform producing circuit 51 and the address voltage applying circuit 52. Furthermore, the scan sections Ba1 and Ba2 set the scan electrode group drive signals VCg1 and VCg2 to the discharge route potentials V1 and V2, respectively. The positive setup waveform producing circuit 54 produces a positive sub-setup pulse rising monotonically from the positive-direction setup start potential Vst1 to the positive setup peak potential Vst. The positive setup waveform producing circuit 54 supplies the positive sub-setup pulse to the scan electrode group SCg1 via the common discharge route R0, the group switch section SW1, the discharge route R1 and the scan section Ba1. At the same time, the positive setup waveform producing circuit 54 supplies the positive sub-setup pulse to the scan electrode group SCg2 via the group switch section SW2, the discharge route R2 and the scan section Ba2. The positive sub-setup pulse forms part of the setup pulse. In other words, the respective scan electrode group drive signals VCg1 and VCg2 are set to setup pulses having the same waveform.

On the other hand, since the switch section SWf is turned on, the sustain electrode drive circuit 6 sets the sustain electrode drive signal VU to the ground potential.

1-3-2 Sub-Setup Period TI2

The sub-setup period 112 is the period from time point T2 to time point T3, and the operation state ST in the period is the operation state ST2. The switch sections SW1, SW2 and SWi are turned off, and the switch sections SWI2 and SWi and the switch section groups SWh1 and SWh2 are turned on. Hence, the discharge routes R1 and R2 are separated from the sustain pulse generating circuit 53, the positive setup waveform producing circuit 54 and the address voltage applying circuit 52. Furthermore, the scan sections Ba1 and Ba2 set the scan electrode group drive signals VCg1 and VCg2 to the discharge route potentials V1 and V2, respectively. The negative setup waveform producing circuit 51 produces a negative sub-setup pulse lowering monotonically from the negative-direction setup start potential Vad1 to the scan peak potential Vad. The negative setup waveform producing circuit 51 supplies the negative sub-setup pulse to the scan electrode group SCg1 via the discharge route R1 and the scan section Ba1. At the same time, the negative setup waveform producing circuit 51 supplies the negative sub-setup pulse to the scan electrode group SCg2 via the discharge route R1, the switch section SWI2, the discharge route R2 and the scan section Ba2. The negative sub-setup pulse forms part of the setup pulse. In other words, the scan electrode group drive signals VCg1 and VCg2 are set to setup pulses having the same waveform.

On the other hand, at the same time when the switch section SWf is turned off, the supply voltage of the sustain pulse voltage supply Esu2 is set to the sustain electrode offset voltage Ve. Hence, the sustain electrode drive circuit 6 sets the sustain electrode drive signal VU to the sustain electrode offset potential Ve.

1-3-3 Precedent Writing Period Tw0

The writing period TW includes a precedent writing period Tw0 and the scan period TC. The precedent writing period Tw0 is the period from time point T3 to time point T4, and the operation state ST in the period is the operation state ST5. The switch sections SW1, SW2 and SWi and the switch section groups SWh1 and SWh2 are turned off, and the switch sections SWI2 and SWj are turned on. Hence, the discharge routes R1 and R2 are separated from the sustain pulse generating circuit 53, the positive setup waveform producing circuit 54 and the negative setup waveform producing circuit 51. The address voltage applying circuit 52 sets the discharge route potential V1 to the scan peak potential Vad and sets the discharge route potential V2 to the scan peak potential Vad via the inter-group switch section SWI2. As a result, the scan sections Ba1 and Ba2 set the scan electrode group drive signals VCg1 and VCg2 to the scan reference potential Vnd, respectively. The scan reference potential Vnd represents a non-selection potential.

On the other hand, at the same time when the switch section SWf is turned off, the supply voltage of the sustain pulse voltage supply Esu2 is set to the sustain electrode offset voltage Ve. Hence, the sustain electrode drive circuit 6 sets the sustain electrode drive signal VU to the sustain electrode offset potential Ve.

1-3-4 Sub-Scan Period TC1

The scan period TC includes a sub-scan period TC1 and a sub-scan period TC2. The sub-scan period TC1 is the period from time point T4 to time point T7. The operation state ST in the period is the operation state ST3 in the period from time point T4 to time point T5 and in the period from time point T6 to time point T7 and is the operation state ST4 in the period from time point T5 to time point T6. In the operation states ST3 and ST4, the switch sections SWd, SW1, SWI2 and SWi and the switch section group SWh2 are turned off, and the switch sections SWb, SWc, SW2 and SWj are turned on. Hence, the discharge route R1 is separated from the sustain pulse generating circuit 53, the positive setup waveform producing circuit 54 and the complex switch section 50, and the discharge route potential V1 is set to the scan peak potential Vad. Furthermore, the discharge route R2 is separated from the positive setup waveform producing circuit 54, the group switch section SW1 and the inter-group switch section SWI2, and connected to the ground terminal GND1, and the discharge route potential V2 is set to the ground potential. As a result, the scan section Ba2 sets the scan electrode group drive signals VCg2 to a reference raising potential Vpa representing a potential having a potential difference of the scan reference voltage Vsc in the direction of the positive setup peak potential Vst with respect to the ground potential.

Furthermore, the switch section group SWh1 is turned off in the operation state ST3 and turned on in the operation state ST4. As a result, the scan section Ba1 sets the scan electrode group drive signals VCg1 to the scan reference potential Vnd in the operation state ST3 and to the scan peak potential Vad in the operation state ST4. In this way, the scan section Ba1 produces a scan pulse by carrying out switching between the scan peak potential Vad and the scan reference potential Vnd throughout the sub-scan period TC1 and sequentially supplies the scan pulse to n1 pieces of scan electrodes within the scan electrode group SCg1 according to the scan electrode drive circuit control signal S3C. The scan reference potential Vnd represents a non-selection potential, and the scan peak potential Vad represents a selection potential. In addition, the scan section Ba2 sets the scan electrode group drive signals VCg2 to the reference raising potential Vpa throughout the sub-scan period TC1. The reference raising potential Vpa represents a non-selection potential. Since the reference raising potential Vpa is between the setup peak potential Vst and the scan reference potential Vnd and since (Vnd=Vad+Vsc) and (Vpa=Vsc) are established, the reference raising potential Vpa is higher than the scan reference potential Vnd by the scan peak potential Vad.

On the other hand, in the operation states ST3 and ST4, at the same time when the switch section SWf is turned off, the supply voltage of the sustain pulse voltage supply Esu2 is set to the sustain electrode offset voltage Ve. Hence, the sustain electrode drive circuit 6 sets the sustain electrode drive signal VU to the sustain electrode offset potential Ve.

1-3-5 Sub-Scan Period TC2

The sub-scan period TC2 is the period from time point T7 to time point T10. The operation state ST in the period is the operation state ST5 in the period from time point T7 to time point T8 and in the period from time point T9 to time point T10 and is the operation state ST6 in the period from time point T8 to time point T9. Since the operation in the operation state ST5 is similar to the operation in the precedent writing period TWO, its description is omitted. In the operation state ST6, the switch sections SW1, SW2 and SWi and the switch section group SWh1 are turned off, and the switch sections SWI2 and SWj and the switch section group SWh2 are turned on. Hence, the discharge routes R1 and R2 are separated from the sustain pulse generating circuit 53, the positive setup waveform producing circuit 54 and the negative setup waveform producing circuit 51. The address voltage applying circuit 52 sets the discharge route potential V1 to the scan peak potential Vad, and the inter-group switch section SWI2 supplies the set scan peak potential Vad to the scan electrode group drive section Bb2. The scan electrode group drive section Bb2 sets the discharge route potential V2 to the scan peak potential Vad. As a result, the scan section Ba1 sets the scan electrode group drive signals VCg1 to the scan reference potential Vnd, and the scan section Ba2 sets the scan electrode group drive signals VCg2 to the scan peak potential Vad.

In this way, the scan section Ba1 sets the scan electrode group drive signals VCg1 to the scan reference potential Vnd throughout the sub-scan period TC2. The scan reference potential Vnd represents a non-selection potential. In addition, the scan section Ba2 produces a scan pulse by carrying out switching between the scan peak potential Vad and the scan reference potential Vnd throughout the sub-scan period TC2 and sequentially supplies the scan pulse to n2 pieces of scan electrodes within the scan electrode group SCg2 according to the scan electrode drive circuit control signal S3C. The scan reference potential Vnd represents a non-selection potential, and the scan peak potential Vad represents a selection potential.

On the other hand, in the operation states ST5 and ST6, at the same time when the switch section SWf is turned off, the supply voltage of the sustain pulse voltage supply Esu2 is set to the sustain electrode offset voltage Ve. Hence, the sustain electrode drive circuit 6 sets the sustain electrode drive signal VU to the sustain electrode offset potential Ve.

1-3-6 Sustain Period TU

The sustain period TU is a period during which the period from time point T10 to time point TI2 is repeated by a predetermined number of times. The operation state ST in the period is the operation state ST7 in the period from time point T10 to time point TI1 and is the operation state ST8 in the period from time point TI1 to time point TI2. In the operation states ST7 and ST8, the switch sections SWd, SWI2, SWi and SWj are turned off, and the switch sections SWc, SW1 and SW2 and the switch section groups SWh1 and SWh2 are turned on. Hence, the respective discharge routes R1 and R2 are separated from the positive setup waveform generating circuit 54, the inter-group switch section SWI2, the negative setup waveform producing circuit 51 and the address voltage applying circuit 52. In addition, the scan sections Ba1 and Ba2 set the scan electrode group drive signals VCg1 and VCg2 to the discharge route potentials V1 and V2, respectively.

Furthermore, the switch section SWb is turned on in the operation state ST7 and turned off in the operation state ST8. Hence, the sustain pulse generating circuit 53 produces sustain pulses varying alternately and repeatedly between the ground potential and the sustain pulse voltage Vsu. The sustain pulse generating circuit 53 supplies the sustain pulses to the scan electrode group SCg1 via the common discharge route R0, the group switch section SW1, the discharge route R1 and the scan section Ba1. At the same time, the sustain pulse generating circuit 53 supplies the sustain pulses to the scan electrode group SCg2 via the group switch section SW2, the discharge route R2 and the scan section Ba2. In other words, the scan electrode group drive signals VCg1 and VCg2 are set to the sustain pulses having the same waveform throughout the sustain period TU.

Furthermore, when the switch section SWb is turned on in the operation state ST7, the switch section SWf is turned off. When the switch section SWb is turned off in the operation states ST8, the switch section SWf is turned on. Hence, throughout the sustain period TU, the sustain electrode drive circuit 6 produces sustain pulses synchronized with and inverted from the sustain pulses of the sustain pulse generating circuit 53 and supplies the sustain electrode drive signal VU representing the sustain pulses to the sustain electrode groups SUg1 and SUg2.

1-4 Summary and Effect

As described above, in Embodiment 1, in the scan system for sequentially supplying a scan pulse to the scan electrodes of the PDP, a two-group configuration has been described in which the total number of the scan electrodes is divided into two groups and driven. In this case, the sustain pulse generating circuit 53, the positive setup waveform producing circuit 54, the negative setup waveform producing circuit 51 and the address voltage applying circuit 52 are necessary, each only one in number, as in the case of a one-group configuration in which the total number of the scan electrodes is driven as one group. However, two group switch sections and two scan sections are necessary and one inter-group switch section SWI2 is provided additionally. For example, when it is assumed that the scan section is formed of a 64-output single-chip semiconductor integrated circuit (IC) and that the number n of the scan electrodes is 1024, 16 scan sections are necessary even in the case of the one-group configuration. In the case of the two-group configuration, the number of the scan sections is not increased substantially since eight scan sections are used for each of the scan sections Bb1 and Bb2.

Furthermore, even in the case of the one-group configuration, the group switch section is necessary to separate the positive setup waveform producing circuit 54 in the sub-setup period TI2 and to separate the sustain pulse generating circuit 53 in the scan period TC. Since the group switch section is inserted in series with the discharge route, the total amount of the current flowing therethrough reaches up to several hundreds amperes. To securely obtain the total amount of the current, the group switch section is formed of several to more than ten switching elements connected in parallel, for example. In the case of the two-group configuration, since the multiple switching elements are simply divided into two groups in proportion to the amount of the current, the number of the switching elements is not increased substantially. Even when the multiple switching elements are integrated into a single-chip IC, the multiple switching elements inside the IC should only be divided into two groups in proportion to the amount of the current, and each group of the switching elements should only be used. Even in the two-group configuration described above, one inter-group switch section SWI2 and one control line for the inter-group switch section SWI2 should only be added substantially. Hence, the two-group configuration can be attained by adding only the minimum amount of circuits.

In the two-group configuration according to Embodiment 1, in the sub-scan period TC2, the inter-group switch section SWI2 is turned on, whereby the address voltage applying circuit 52 within the scan electrode group drive section Bb1 supplies the scan peak voltage Vad to the scan electrode group drive section Bb2 via the inter-group switch section SWI2. As a result, the scan electrode group drive section Bb2 produces a scan pulse based on the scan peak voltage Vad of the scan electrode group drive section Bb1, and the scan electrode group drive section Bb1 produces the scan reference potential Vnd based on the scan peak voltage Vad. Hence, the address voltage applying circuit 52, although one in number, can obtain an effect similar to that of the case in which totally two in number are provided for the two-group configuration.

On the other hand, in the sub-scan period TC1, the scan electrode group drive section Bb1 produces a scan pulse based on the scan peak voltage Vad by turned off the inter-group switch section SWI2. The scan electrode group drive section Bb2 produces the reference raising potential Vpa regardless of the scan peak voltage Vad of the scan electrode group drive section Bb1. As described later, the reference raising potential Vpa is required to be made sufficiently higher than the scan reference potential Vnd. In the sub-scan period TC1, when it is assumed that the inter-group switch section SWI2 is turned on, the discharge route potential V2 is set to the scan peak voltage Vad. Even in this case, in order that the reference raising potential Vpa is raised, a potential similar to the reference raising potential Vpa that is used when the inter-group switch section SWI2 is turned off must be applied to the scan electrode group drive signals VCg2. Hence, for example, the voltage supplied from the scan reference voltage supply Esc2 is required to be made higher than the scan reference voltage Vsc by the absolute value of the scan peak voltage Vad (see FIG. 7). In other words, totally the voltage higher by the absolute value of the scan peak potential Vad is applied to the respective switch section groups SWg2 and SWh2 within the scan section Ba2. However, the voltage applied to the respective switch section groups SWg2 and SWh2 is made lower by turning off the inter-group switch section SWI2, whereby the scan section Ba2 is improved in reliability and reduced in cost.

As in the case of the negative setup waveform producing circuit 51, in the sub-setup period TI2, the inter-group switch section SWI2 is turned on. Hence, the negative setup waveform producing circuit 51 within the scan electrode group drive section Bb1 supplies the negative sub-setup pulse to the scan electrode group drive section Bb2 via the inter-group switch section SWI2. As a result, the scan electrode group drive sections Bb1 and Bb2 supply the negative sub-setup pulse to the scan electrode groups SCg1 and SCg2, respectively. Hence, the negative setup waveform producing circuit 51, although one in number, can obtain an effect similar to that of the case in which totally two in number are provided for the two-group configuration.

Furthermore, the positive setup waveform producing circuit 54 can supply the positive sub-setup pulse to the two groups in common in the sub-setup period TI1. Similarly, the sustain pulse generating circuit 53 can also supply the sustain pulses to the two groups in common in the sustain period TU. Hence, the positive setup waveform producing circuit 54 and the sustain pulse generating circuit 53, although each being one in number, can each obtain an effect similar to that of the case in which totally two in number are provided for the two-group configuration.

In addition, in the sub-scan period TC1, although the non-selection potential of the first group is the scan reference potential Vnd, the non-selection potential of the second group becomes the reference raising potential Vpa. Hence, the non-selection potential of the second group can be made higher than that of the first group by the scan peak potential Vad.

The period from the time after the wall charges are accumulated in the setup period ST and to the time until the scan pulse is supplied in the writing period TW, the period being also referred to as a scan-waiting period, becomes relatively longer as the writing period TW reaches closer to its end in the case of the single scan system. However, in the two-group configuration, since the reference raising potential Vpa can be made sufficiently higher than the scan reference potential Vnd in the second group as described above, the neutralization of the wall charges inside the discharge cell can be minimized, and addressing errors hardly occur. Hence, stable driving becomes possible, and the ambient temperature of the PDP can be set high. Furthermore, since the PDP drive circuit is not required to operate on high voltages, the number of circuit components having high withstand voltages is reduced and power consumption is also reduced due to the lowering of the power supply voltage.

Even in the two-group configuration, the amount of circuits required for the configuration is less than that for two groups as described above. Hence, the installation area of the PDP drive circuit is reduced. Furthermore, the effect of cost reduction is high due to the reduction in the amount of circuits and in the number of circuit components having high withstand voltages as described above.

Embodiment 2

In Embodiment 2, differences from Embodiment 1 will be mainly described below. Except for the differences, the configuration, operation and effect of Embodiment 2 are similar to those of Embodiment 1, and their description is omitted.

2-1 Configuration and Operation of the PDP Drive Circuit (Offset Potential Producing Section 55)

Figure 8:
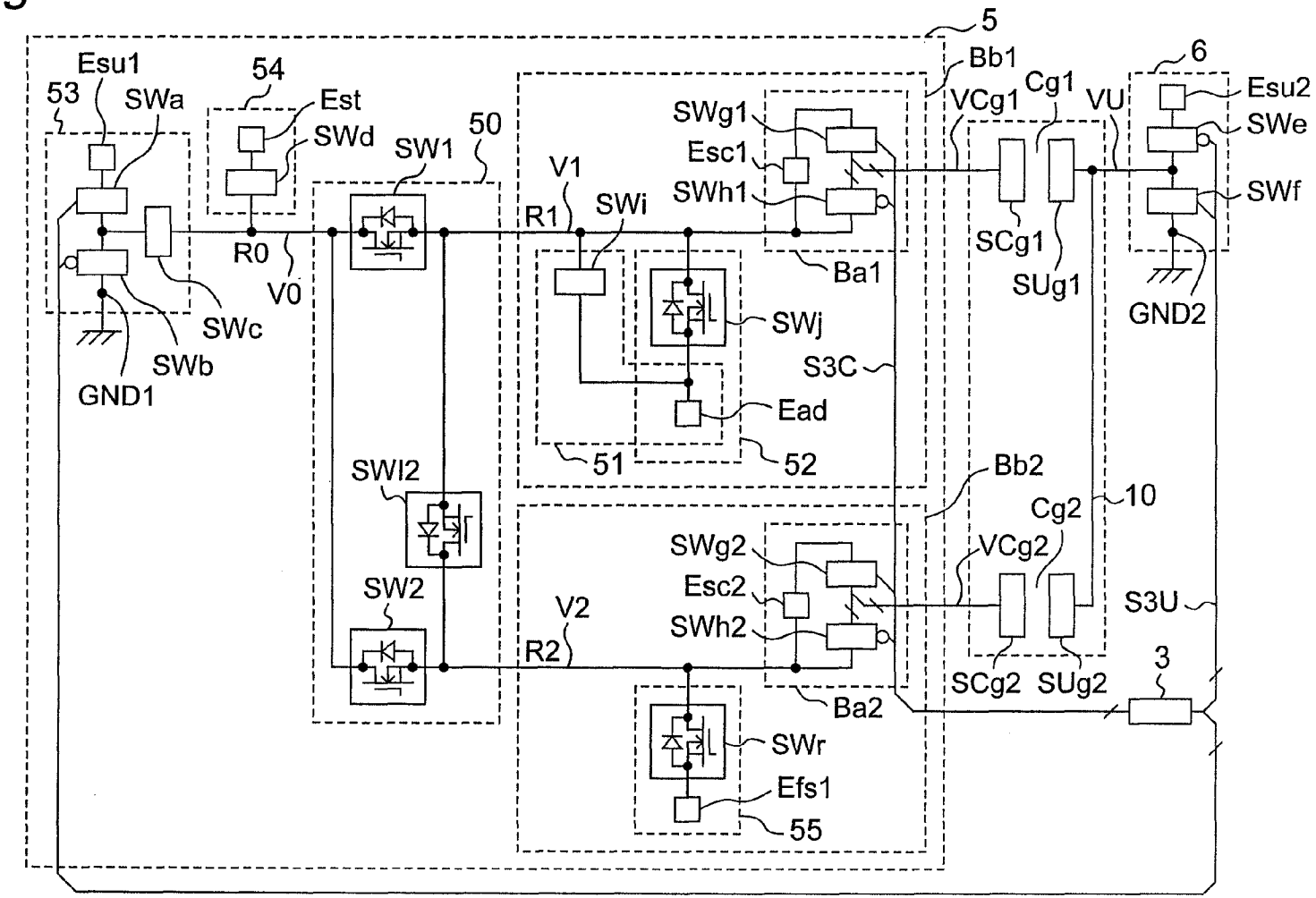
FIG. 8 is a block diagram showing the configuration of a PDP drive circuit according to Embodiment 2 of the present invention.
Figure 9:
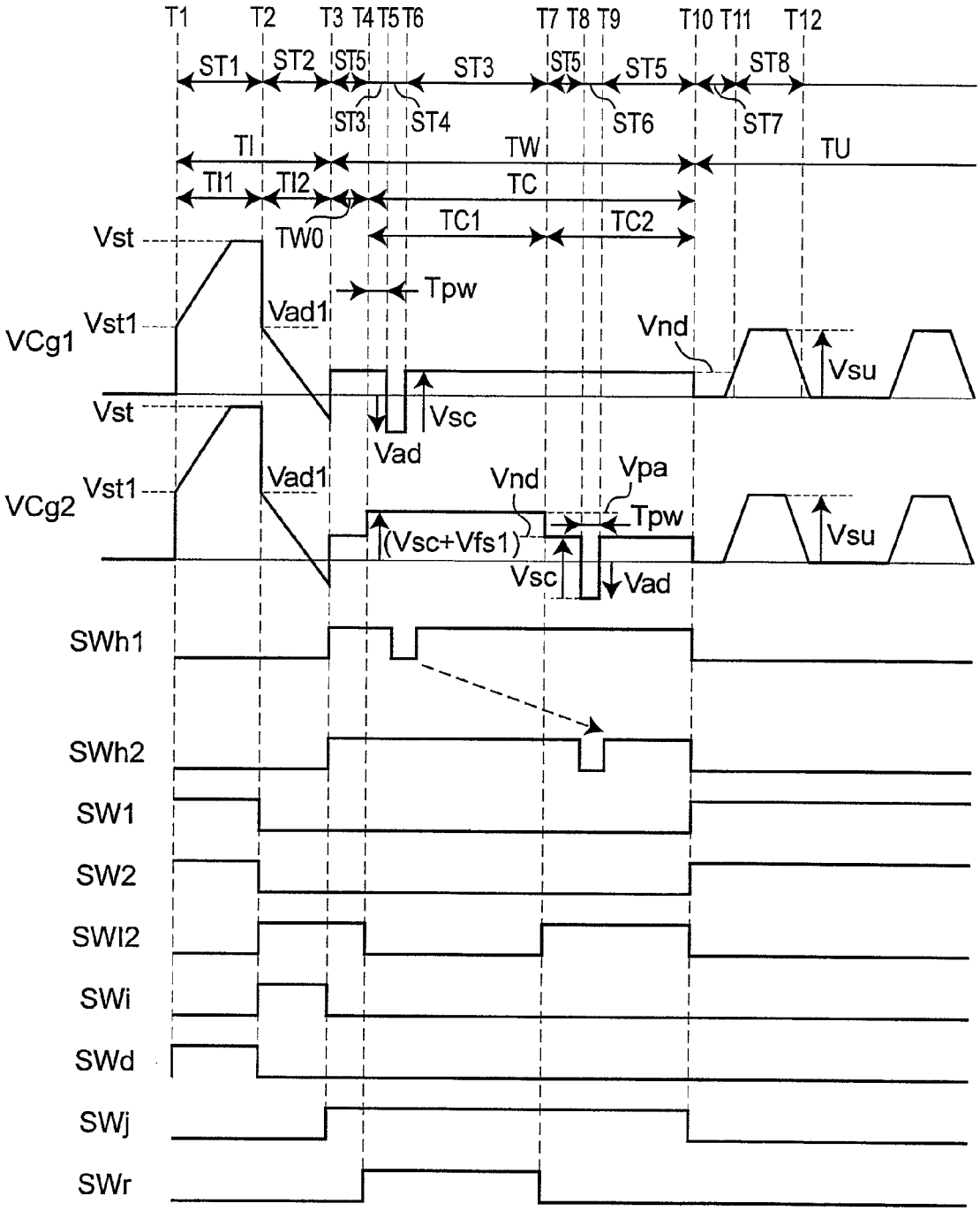
FIG. 9 is a waveform diagram showing the waveforms of the drive voltages in the PDP drive circuit according to Embodiment 2 of the present invention.

FIG. 8 is a block diagram showing the configuration of the PDP drive circuit according to Embodiment 2. FIG. 9 is a waveform diagram showing the waveforms of the drive voltages of the PDP drive circuit according to Embodiment 2. In comparison with Embodiment 1 shown in FIG. 1, the scan electrode group drive section Bb2 further comprises an offset potential producing section 55 connected to the discharge route R2. The offset potential producing section 55 comprises an offset voltage supply Efs1 for supplying a predetermined negative offset voltage Vfs1 and a switch section SWr, the source terminal of which is connected to the offset voltage supply Efs1 and the drain terminal of which is connected to the discharge route R2. The body diode of the switch section SWr is disposed in the direction of shutting off the current flowing from the discharge route R2 to the offset voltage supply Efs1. The potential level of the offset voltage Vfs1 with respect to the ground potential is also referred to as an offset potential Vfs1. In Embodiment 2, the offset potential Vfs1 is a negative potential. The offset potential producing section 55 sets the discharge route potential V2 to the offset potential Vfs1 by turning on the switch section SWr in the sub-scan period TC1.

2-2 Operation Sequence of the PDP Drive Circuit (Sub-Scan Period TC1)

The operation sequence is different from that in Embodiment 1 in that the state of the group switch section SW2 is changed from the on state to the off state and the switch section SWr provided additionally is turned on in the sub-scan period TC1 from time point T4 to time point T7, and that the switch section SWr is turned off in the other periods. Hence, in the sub-scan period TC1, the discharge route R2 is separated from the sustain pulse generating circuit 53, the positive setup waveform producing circuit 54 and the complex switch section 50, and the discharge route potential V2 is set to the offset potential Vfs1. As a result, the scan section Ba2 sets the scan electrode group drive signals VCg2 to the reference raising potential Vpa representing a potential having a potential difference of the scan reference voltage Vsc in the direction of the positive setup peak potential Vst with respect to the offset potential Vfs1.

In Embodiment 2, the reference raising potential Vpa is between a potential (the reference raising potential VPa according to Embodiment 1) having a potential difference of the scan reference voltage Vsc in the direction of the positive setup peak potential Vst and the scan reference potential Vnd with respect to the ground potential. Since (Vnd=Vad+Vsc) and (Vpa=Vsc+Vfs1) are established, the reference raising potential Vpa is higher than the scan reference potential Vnd by (Vfs1−Vad). In other words, the offset potential Vfs1 is between the ground potential and the scan peak potential Vad.

2-3 Summary and Effect

As described above, in Experiment 2, the scan electrode group drive section Bb2 is provided with the offset potential producing section 55. Hence, in the sub-scan period TC1, the limitation (in Embodiment 1) of the reference raising potential Vpa to the potential level having a potential difference of the scan peak potential Vad in the direction of the positive setup peak potential Vst with respect to the reference potential Vnd is not required to be carried out. In other words, the reference raising potential Vpa can be set to a desired potential level. In particular, the inter-group switch section SWI2 is not required to have a high withstand voltage by lowering the potential level of the reference raising potential Vpa so as to be less than that in Embodiment 1, and power consumption is reduced further.

Embodiment 3

In Embodiment 3, differences from Embodiment 1 will be mainly described below. Except for the differences, the configuration, operation and effect of Embodiment 3 are similar to those of Embodiment 1, and their description is omitted.

3-1 Configuration and Operation of the PDP Drive Circuit (Offset Potential Producing Section 56)

Figure 10:
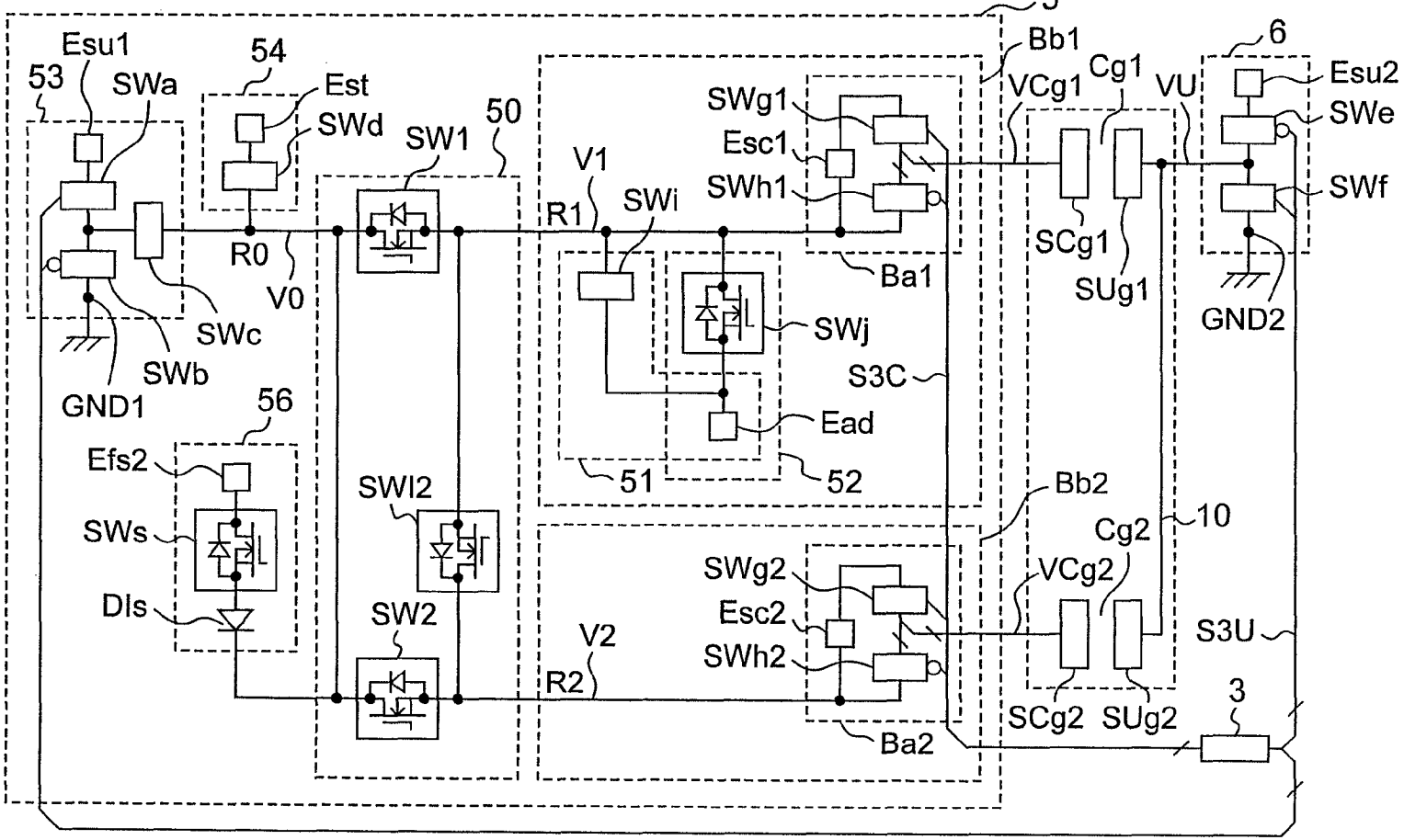
FIG. 10 is a block diagram showing the configuration of a PDP drive circuit according to Embodiment 3 of the present invention.
Figure 11:
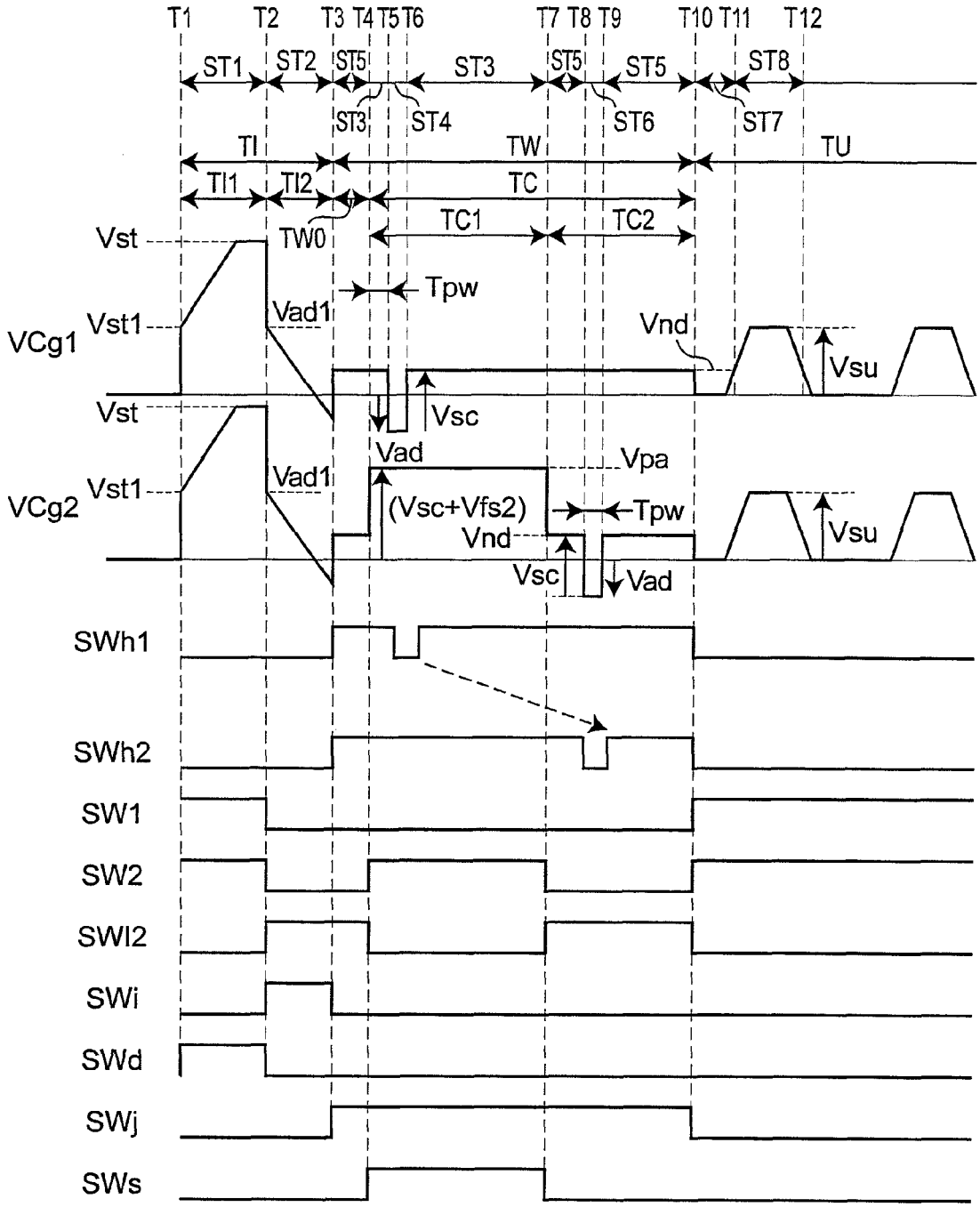
FIG. 11 is a waveform diagram showing the waveforms of the drive voltages in the PDP drive circuit according to Embodiment 3 of the present invention.

FIG. 10 is a block diagram showing the configuration of the PDP drive circuit according to Embodiment 3. FIG. 11 is a waveform diagram showing the waveforms of the drive voltages of the PDP drive circuit according to Embodiment 3. In comparison with Embodiment 1 shown in FIG. 1, the scan electrode drive circuit 5 further comprises an offset potential producing section 56 connected to the common discharge route R0. The offset potential producing section 56 comprises an offset voltage supply Efs2, a switch section SWs and a diode section DIs. The offset voltage supply Efs2 supplies a predetermined positive offset voltage Vfs2. The drain terminal of the switch section SWs is connected to the offset voltage supply Efs2. The anode terminal of the diode section DIs is connected to the source terminal of the switch section SWs, and the cathode terminal thereof is connected to the common discharge route R0. The body diode of the switch section SWs is disposed in the directions of shutting off the current flowing from the offset voltage supply Efs2 to the common discharge route R0. The diode section DIs is disposed in the direction of shutting off the current flowing from the discharge route R2 to the offset voltage supply Efs2. The potential level of the offset voltage Vfs2 with respect to the ground potential is also referred to as an offset potential Vfs2. In Embodiment 3, the offset potential Vfs2 is a positive potential. The offset potential producing section 56 sets the common discharge route potential V0 and the discharge route potential V2 to the offset potential Vfs2 by turning on the switch section SWs and the switch section sw2 in the sub-scan period TC1.

3-2 Operation Sequence of the PDP Drive Circuit (sub-Scan Period TC1)

The operation sequence is different from that in Embodiment 1 in that the state of the switch section SWc is changed from the on state to the off state and the switch section SWs provided additionally is turned on in the sub-scan period TC1 from time point T4 to time point T7, and that the switch section SWs is turned off in the other periods. At this time, instead of the switch section SWc, the switch section SWb may be turned off. Hence, in the sub-scan period TC1, the common discharge route R0 is separated from the sustain pulse generating circuit 53 and the positive setup waveform producing circuit 54 and connected to the discharge route R2. Therefore, the common discharge route potential V0 and the discharge route potential V2 are set to the offset potential Vfs2. As a result, the scan section Ba2 sets the scan electrode group drive signals VCg2 to the reference raising potential Vpa representing a potential having a potential difference of the scan reference voltage Vsc in the direction of the positive setup peak potential Vst with respect to the offset potential Vfs2.

In Embodiment 3, the reference raising potential Vpa is between the setup peak potential Vst and a potential (the reference raising potential VPa according to Embodiment 1) having a potential difference of the scan reference voltage Vsc in the direction of the positive setup peak potential Vst with respect to the ground potential. Hence, the reference raising potential Vpa is higher than that in Embodiment 1 by the offset potential Vfs2.

3-3 Summary and Effect

As described above, in Experiment 3, the scan electrode group drive section Bb2 is provided with the offset potential producing section 56. Hence, in the sub-scan period TC1, the limitation (in Embodiment 1) of the reference raising potential Vpa to the potential level having a potential difference of the scan peak potential Vad in the direction of the positive setup peak potential Vst with respect to the reference potential Vnd is not required to be carried out. In other words, the reference raising potential Vpa can be set to a desired potential level. In particular, the driving can be carried out stably and the ambient temperature of the PDP can be set high in comparison with Embodiment 1 by raising the potential level of the reference raising potential Vpa so as to be higher than that in Embodiment 1.

Embodiment 4

In Embodiment 4, differences from Embodiment 1 will be mainly described below. Except for the differences, the configuration, operation and effect of Embodiment 4 are similar to those of Embodiment 1, and their description is omitted.

Figure 12:
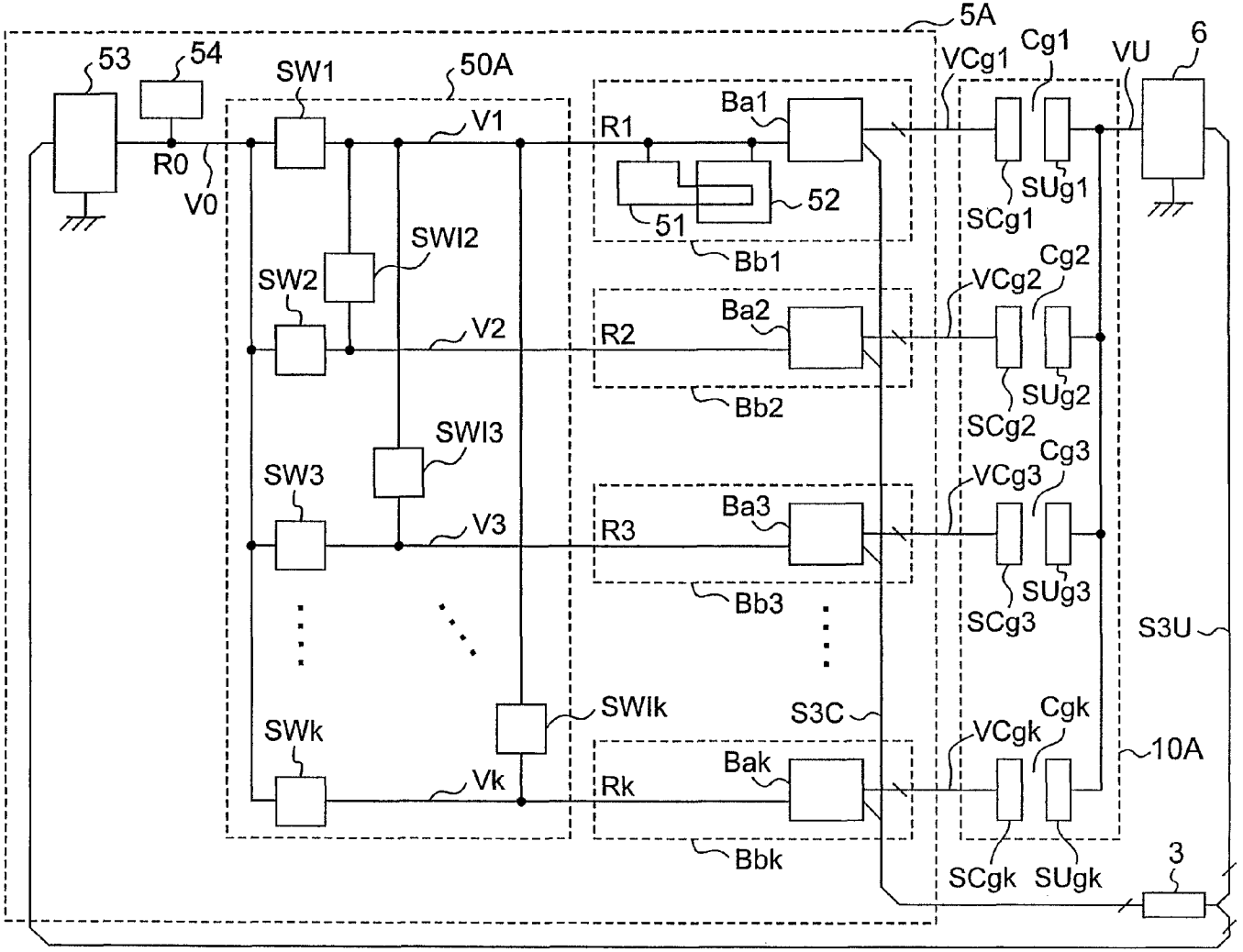
FIG. 12 is a block diagram showing the configuration of a PDP drive circuit according to Embodiment 4 of the present invention.
Figure 13:
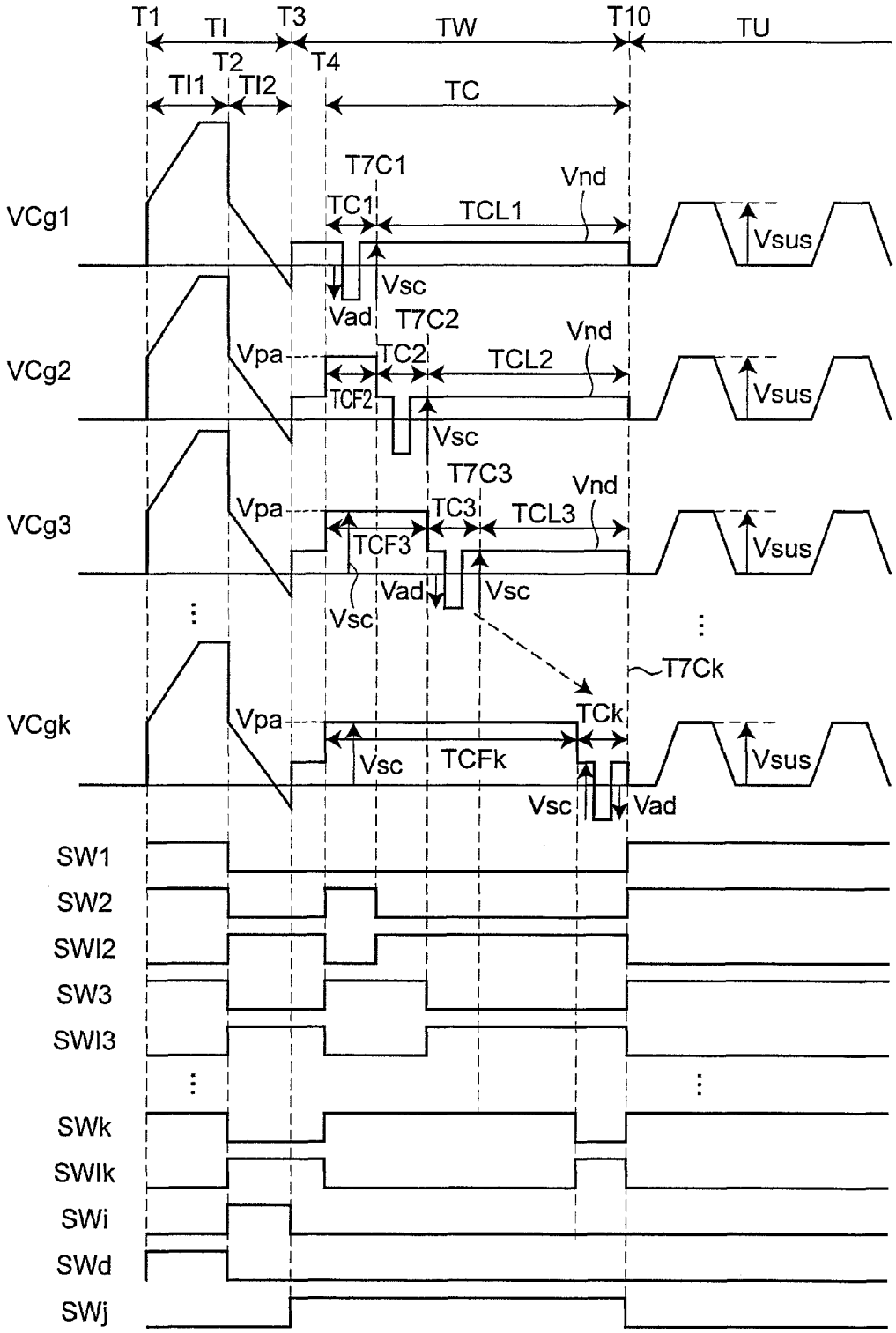
FIG. 13 is a waveform diagram showing the waveforms of the drive voltages in the PDP drive circuit according to Embodiment 4 of the present invention.
Figure 14:
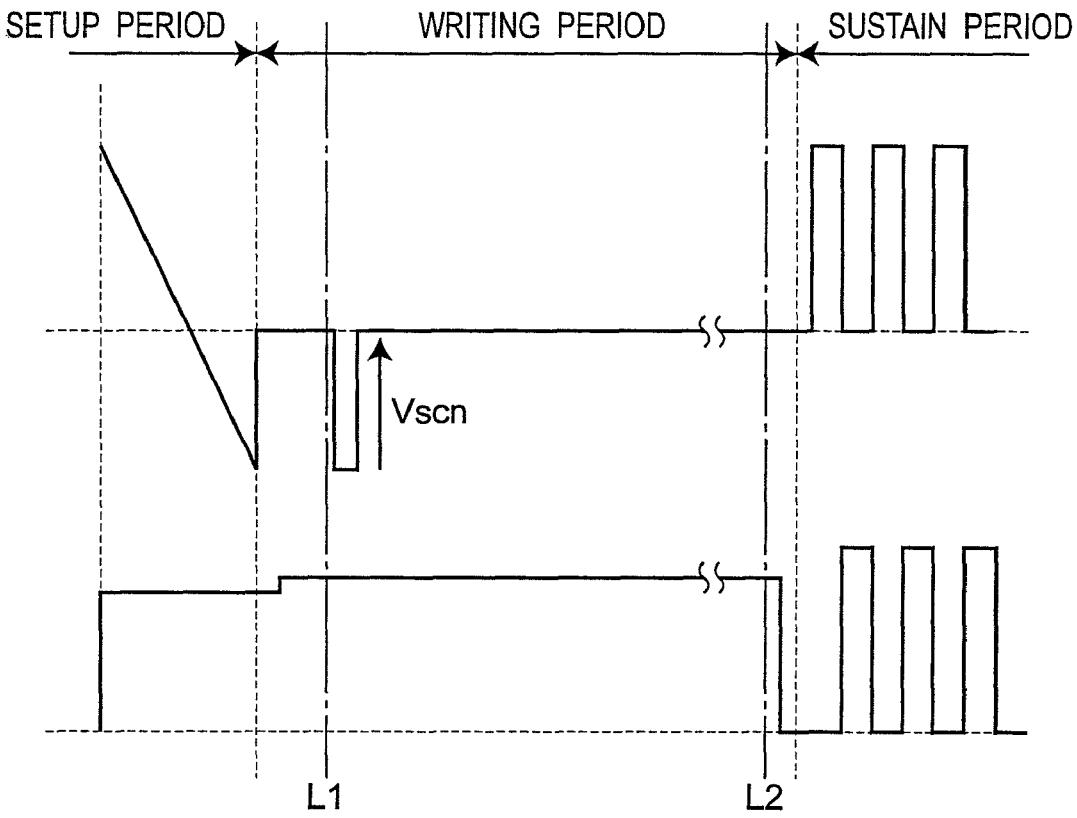
FIG. 14 is a waveform diagram showing the waveforms of the drive voltages in the PDP drive circuit according to the conventional example.
Figure 15A:
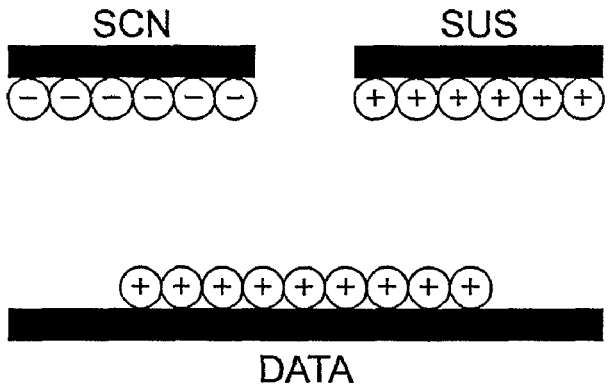
FIG. 15A is a schematic view showing the distribution state of wall charges on the respective electrodes of the PDP according to the conventional example.
Figure 15B:
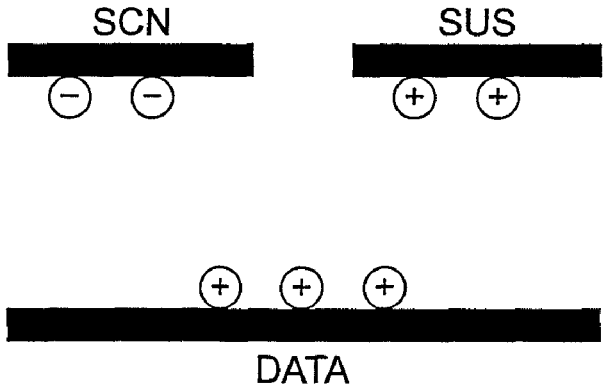
FIG. 15B is another schematic view showing the distribution state of wall charges on the respective electrodes of the PDP according to the conventional example.
Figure 16:
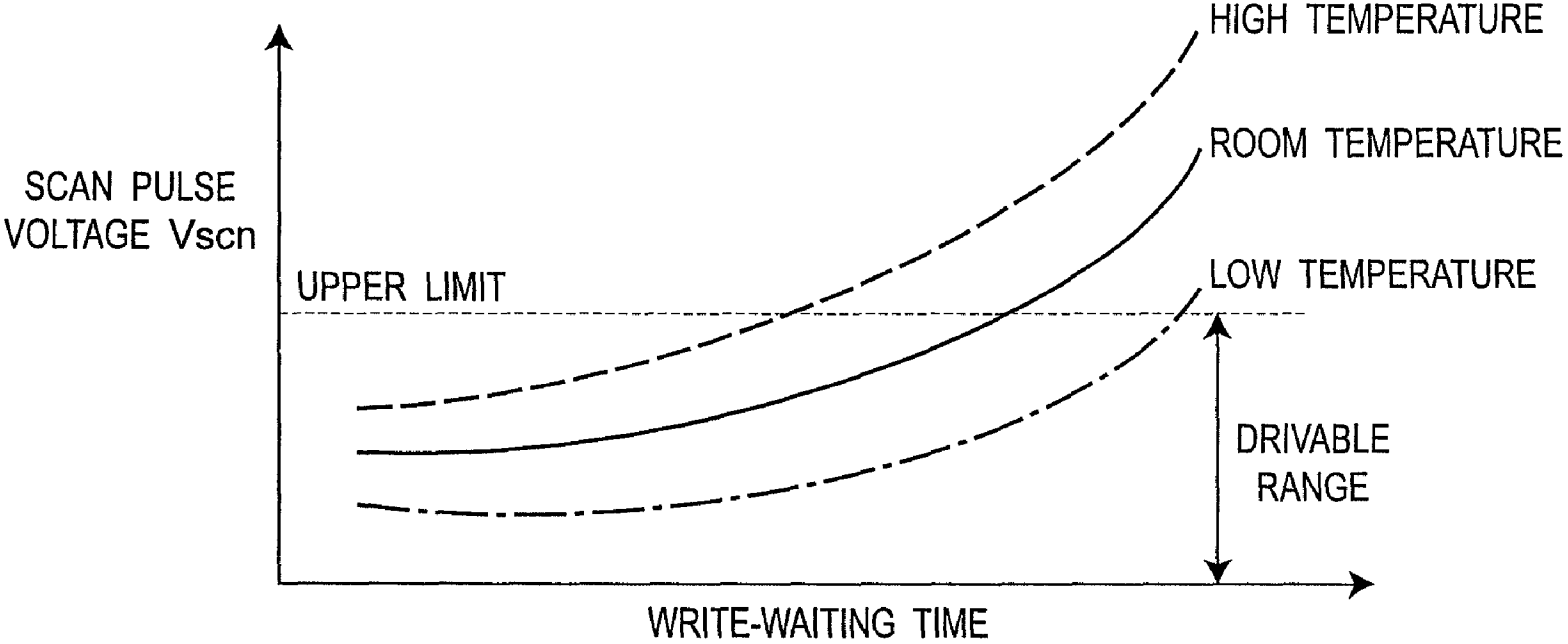
FIG. 16 is a view showing the relationship between the drive voltage and the writing characteristics of the PDP drive circuit according to the conventional example.

4-1 Configuration and Operation of the PDP Drive Circuit 4-1-1 General Description of the PDP Drive Circuit FIG. 12 is a block diagram showing the configuration of the PDP drive circuit according to Embodiment 4. FIG. 13 is a waveform diagram showing the waveforms of the drive voltages of the PDP drive circuit according to Embodiment 4. Unlike the PDP drive circuit according to Embodiment 1 shown in FIG. 1, the PDP drive circuit according to Embodiment 4 has a k-group configuration in which the total number of the scan electrodes is divided into k (k: an integer equal to or larger than 2 and equal to or smaller than n) pieces of groups, and each group is driven. In the PDP 10A, totally n pieces of scan electrodes SCi are divided into scan electrode groups SCg1, SCg2, SCgk. The scan electrode group SCgw includes nw pieces of scan electrodes for the scanning in the sub-scan period TCw (w=1, 2, . . . , k). Similarly, totally n pieces of sustain electrode SUi are divided into sustain electrode groups SUg1, SUg2, SUgk. The sustain electrode group SUgw includes nw pieces of sustain electrodes respectively paired with nw pieces of scan electrodes within the scan electrode group SCgw (w=1, 2, . . . , k). In addition, (n1+n2++nk=n) is established. Usually, n is almost equally divided into n1, n2, . . . nk; however, it may be divided unequally.

The scan electrode drive circuit 5A of the PDP drive circuit comprises the sustain pulse generating circuit 53, the positive setup waveform producing circuit 54, a complex switch section 50A and k pieces of scan electrode group drive sections Bb1, Bb2, Bbk. One terminal of the complex switch section 50A is connected to the common discharge route R0, and k pieces of other terminals thereof are connected to the scan electrode group drive sections Bbw via discharge routes Rw (w=1, 2, . . . , k). The other terminals of the scan electrode group drive sections Bbw are connected to nw pieces of the scan electrodes within the scan electrode group SCgw using separate wires (w=1, 2, . . . , k). On the other hand, one terminal of the sustain electrode drive circuit 6 is connected to totally n pieces of the sustain electrodes within the sustain electrode groups SUg1, SUg2, SUgk, each being connected using a single wire.

4-1-2 Complex Switch Section 50A

The complex switch section 50A comprises k pieces of group switch sections SW1, SW2, SWk and (k−1) pieces of inter-group switch sections SWI2, SWI3, SWIk. The drain terminal of the group switch section SWw is connected to the common discharge route R0, and the source terminal thereof is connected to the scan electrode group drive section Bbw via the discharge route Rw, whereby the group switch section SWw turns on/off the connection between the common discharge route R0 and the scan electrode group drive section Bbw (w=1, 2, . . . , k).

In the k-group configuration according to Embodiment 4, the group switch section SW1 and the scan electrode group drive section Bb1 constitute a first group sub-scan electrode drive circuit. Similarly, the group switch section SWw, the inter-group switch section SWIw and the scan electrode group drive section Bbw constitute a w-th group sub-scan electrode drive circuit (w=2, 3, . . . , k). The scan electrode drive circuit 5 comprises the sustain pulse generating circuit 53, the positive setup waveform producing circuit 54, the first group sub-scan electrode drive circuit and (k−1) pieces of the w-th group sub-scan electrode drive circuits (w=2, 3, . . . , k). The first group sub-scan electrode drive circuit is also referred to as the first group, and the w-th group sub-scan electrode drive circuit is also referred to as the w-th group (w=2, 3, . . . , k).

The source terminal of the inter-group switch section SWIw is connected to the discharge route R(w−1), and the drain terminal thereof is connected to the discharge route Rw, whereby the inter-group switch section SWIw turns on/off the connection between the discharge route R(w−1) and the discharge route Rw (w=2, 3, . . . , k). The discharge route R(w−1) herein represents the discharge route of the (w−1)th group (w=2, 3, . . . , k). Each potential Vw of the discharge route Rw is also referred to as a discharge route potential Vw (w=1, 2, 3, . . . , k). The body diode of each group switch section SWw is disposed in the direction of shutting off the current flowing from the ground terminal GND1 of the sustain pulse producing circuit 53 to the discharge route Rw (w=1, 2, . . . , k). Furthermore, the body diode of each inter-group switch section SWIw is disposed in the direction of shutting off the current flowing from the discharge route Rw to the discharge route R(w−1) (w=2, 3, . . . , k).

4-1-3 Scan Electrode Group Drive Sections Bb1 and Bbw (w=2, 3, . . . , k)

The scan electrode group drive section Bb1 comprises the negative setup waveform producing circuit 51 connected to the discharge route R1, the address voltage applying circuit 52 also connected to the discharge route R1 and the scan section Ba1 inserted between the discharge route R1 and the scan electrode group SCg1. The scan electrode group drive section Bbw includes the scan section Baw inserted between the discharge route Rw and the scan electrode group SCgw (w=2, 3, . . . , k). Functions similar to those of the negative setup waveform producing circuit 51 and the address voltage applying circuit 52 included in the scan electrode group drive section Bb1 are not included in each scan electrode group drive section Bbw (w=2, 3, . . . , k).

4-2 Operation Sequence of the PDP Drive Circuit 4-2-1 Sub-Setup Period TI1

In the sub-setup period TI1, the positive setup waveform producing circuit 54 produces a positive sub-setup pulse for forming part of the setup pulse and supplies the pulse to each scan electrode group SCgw via the group switch section SWw and the scan electrode group drive section Bbw (w=1, 2, . . . , k).

4-2-2 Sub-Setup Period TI2

In the sub-setup period TI2, the negative setup waveform producing circuit 51 produces a negative sub-setup pulse for forming part of the setup pulse and supplies the pulse to the scan electrode group SCg1 via the scan section Ba1. At the same time, the negative setup waveform producing circuit 51 supplies the negative setup pulse to each scan electrode group SCgw via the inter-group switch section SWIw and the scan electrode group drive section Bbw (w=1, 2, . . . , k).

4-2-3 Scan Period TC

The scan period TC is the period from time point T4 to time point T7Ck (shown in FIG. 13). The operation state ST in the period is herein divided into a first group and a w-th group and described (w=2, 3, . . . , k).

4-2-3-1 First Group

In the first group, the scan period TC is divided into the sub-scan period TC1 from time point T4 to time point T7C1 and the sub-scan period TCL1 from time point T7C1 to time point T7Ck. The operation state ST in the sub-scan period TC1 is similar to that in the sub-scan period TC1 of the first group according to Embodiment 1. The operation state ST in the sub-scan period TCL1 is similar to that in the sub-scan period TC2 of the first group according to Embodiment 1.

In other words, the address voltage applying circuit 52 sets the discharge route potential V1 to the scan peak potential Vad throughout the sub-scan period TC. In the sub-scan period TC1, the scan section Ba1 produces a scan pulse based on the scan peak potential Vad and the scan reference potential Vnd and sequentially supplies the scan pulse to n1 pieces of scan electrodes within the scan electrode group SCg1 according to the scan electrode drive circuit control signal S3C. The scan reference potential Vnd represents a non-selection potential, and the scan peak potential Vad represents a selection potential. In the sub-scan period TCL1, the scan section Ba1 sets the scan electrode group drive signals VCg1 to the scan reference potential Vnd. The scan reference potential Vnd represents a non-selection potential.

4-2-3-2 W-th Group (w=2, 3, . . . , k)

In the w-th group, the scan period TC is divided into a sub-scan period TCFw, a sub-scan period. TCw and a scan period TCIw (w=2, 3, . . . , k). The sub-scan period TCFw is a period from time point T4 to time point T7C(w−1) (w=2, 3, . . . , k). The sub-scan period TCw is a period from time point T7C(w−1) to time point T7Cw (w=2, 3, . . . , k). The sub-scan period TCLw is a period from time point T7Cw to time point T7Ck (w=2, 3, . . . , k). However, the length of the sub-scan period TCLk is substantially zero. The operation state ST in the sub-scan period TCFw is similar to that in the sub-scan period TC1 of the second group according to Embodiment 1 (w=2, 3, . . . , k). The operation states ST in the sub-scan period TCw and the sub-scan period TCLw are similar to that in the sub-scan period TC2 of the second group according to Embodiment 1 (w=2, 3, . . . , k).

In other words, in the sub-scan period TCFw, each discharge route potential Vw is set to the ground potential (w=2, 3, . . . , k). As a result, the scan section Baw sets each scan electrode group drive signal VCgw to the reference raising potential Vpa representing a potential having a potential difference of the scan reference voltage Vsc in the direction of the positive setup peak potential Vst with respect to the offset potential Vfs1 (w=2, 3, . . . , k). The reference raising potential Vpa represents a non-selection potential. Since the reference raising potential Vpa is between the setup peak potential Vst and the scan reference potential Vnd and since (Vnd=Vad+Vsc) and (Vpa=Vsc) are established, the reference raising potential Vpa is higher than the scan reference potential Vnd by the scan peak potential Vad.

In addition, in the sub-scan period TCw and the sub-scan period TCLw, the address voltage applying circuit 52 sets each discharge route potential Vw to the scan peak potential Vad via the inter-group switch section SWIw (w=2, 3, k). As a result, the scan section Baw sets each scan electrode group drive signal VCgw to the scan peak potential Vad or the scan reference potential Vnd (w=2, 3, . . . , k). In the sub-scan period TCw, the scan section Baw produces a scan pulse based on the scan peak potential Vad and the scan reference potential Vnd and sequentially supplies the scan pulse to nw pieces of scan electrodes within the scan electrode group SCgw according to the scan electrode drive circuit control signal S3C (w=2, 3, . . . , k). The scan reference potential Vnd represents a non-selection potential, and the scan peak potential Vad represents a selection potential. In the sub-scan period TCLw, the scan section Baw sets the scan electrode group drive signal VCgw to the scan reference potential Vnd (w=2, 3, . . . , k−1). The scan reference potential Vnd represents a non-selection potential.

4-3 Summary and Effect

As described above, in Embodiment 4, in the scan system for sequentially supplying a scan pulse to the scan electrodes of the PDP, a k-group configuration has been described in which the total number of the scan electrodes is divided into k pieces of groups and driven. In this case, the sustain pulse generating circuit 53, the positive setup waveform producing circuit 54, the negative setup waveform producing circuit 51 and the address voltage applying circuit 52 are necessary, each only one in number, as in the case of a one-group configuration in which the total number of the scan electrodes is driven as one group. However, k pieces of group switch sections and k pieces of scan sections are necessary and (k−1) pieces of inter-group switch sections SWIw are provided additionally (w=2, 3, . . . , k). The number of the scan sections is not increased substantially because of reasons similar to those in Embodiment 1. Furthermore, the number of the group switch sections is not increased substantially because of reasons similar to those in Embodiment 1. As described above, even in the case of the k-group configuration, (k−1) pieces of inter-group switch sections and (k−1) pieces of control lines for the inter-group switch sections are only added substantially. Hence, the k-group configuration can be attained by adding a minimum amount of circuits.

In the k-group configuration according to Embodiment 4, in the sub-scan period TCw and the sub-scan period TCLw, the inter-group switch section SWIw is turned on. Hence, the address voltage applying circuit 52 within the scan electrode group drive section Bb1 supplies the scan peak voltage Vad to each scan electrode group drive section Bbw via the inter-group switch section SWIw (w=2, 3, . . . , k). As a result, each scan electrode group drive section Bbw produces a scan pulse based on the scan peak voltage Vad of the scan electrode group drive section Bb1, and the scan electrode group drive section Bb1 produces the scan reference potential Vnd based on the scan peak voltage Vad (w=2, 3, . . . , k). Hence, the address voltage applying circuit 52, although one in number, can obtain an effect similar to that of the case in which totally k pieces are provided for the k-group configuration.

On the other hand, in the sub-scan period TCFw, the scan electrode group drive section Bb1 produces a scan pulse based on the scan peak voltage Vad by turned off each inter-group switch section SWIw. The scan electrode group drive section Bb2 produces the reference raising potential Vpa regardless of the scan peak voltage Vad of the scan electrode group drive section Bb1 (w=2, 3, . . . , k). As described later, the reference raising potential Vpa is required to be made sufficiently higher than the scan reference potential Vnd. In the sub-scan period TCFw, when it is assumed that the inter-group switch section SWIw is turned on, each discharge route potential Vw is set to the scan peak voltage Vad (w=2, 3, . . . , k). Even in this case, in order that the reference raising potential Vpa is raised, a potential similar to the reference raising potential Vpa that is used when the inter-group switch section SWIw is turned off must be applied to the scan electrode group drive signal VCgw. Hence, for example, the voltage supplied from the scan reference voltage supply within the scan section Baw is required to be made higher than the scan reference voltage Vsc by the absolute value of the scan peak voltage Vad as shown in FIG. 13 (w=2, 3, . . . , k). In other words, totally the voltage higher by the absolute value of the scan peak potential Vad is applied to the respective switch section groups within the scan section Baw (w=2, 3, . . . , k). However, the voltage applied to the respective switch section groups within the scan section Baw is made lower by turning off the inter-group switch section SWIw, whereby the scan section Baw is improved in reliability and reduced in cost (w=2, 3, . . . , k).

As in the case of the negative setup waveform producing circuit 51, in the sub-setup period TI2, the inter-group switch section SWIw is turned on. Hence, the negative setup waveform producing circuit 51 within the scan electrode group drive section Bb1 supplies the negative sub-setup pulse to the scan electrode group drive section Bbw via the inter-group switch section SWIw (w=2, 3, . . . , k). As a result, the scan electrode group drive sections Bb1 and Bbw supply the negative sub-setup pulses to the scan electrode groups SCg1 and SCgw (w=2, 3, . . . , k), respectively. Hence, the negative setup waveform producing circuit 51, although one in number, can obtain an effect similar to that of the case in which totally k pieces are provided for the k-group configuration.

Furthermore, the positive setup waveform producing circuit 54 can supply the positive sub-setup pulse to the k groups in common in the sub-setup period TI1. Similarly, the sustain pulse generating circuit 53 can also supply the sustain pulses to the k groups in common in the sustain period TU. Hence, the positive setup waveform producing circuit 54 and the sustain pulse generating circuit 53, although each being one in number, can each obtain an effect similar to that of the case in which totally k pieces are provided for the k-group configuration.

In addition, in the sub-scan period TC1, although the non-selection potential of the first group is the scan reference potential Vnd, the non-selection potential of the w group becomes the reference raising potential Vpa (w=2, 3, . . . , k) in the sub-scan period TCFw. Hence, the non-selection potential of the w group can be made higher than that of the first group by the scan peak potential Vad (w=2, 3, . . . , k).

In the k-group configuration, the reference raising potential Vpa can be made sufficiently higher than the scan reference potential Vnd in the w group as described above. Hence, the neutralization of the wall charges inside the discharge cell can be minimized because of a reason similar to that in Embodiment 1, and addressing errors hardly occur (w=2, 3, . . . , k). Hence, stable driving becomes possible, and the ambient temperature of the PDP can be set high. Furthermore, since the PDP drive circuit is not necessary to operate on high voltages, the number of circuit components having high withstand voltages is reduced and power consumption is also reduced due to the lowering of the power supply voltage.

The reference raising potential Vpa cannot be set in the first group in any of Embodiment 1 or Embodiment 4. Hence, a scan-waiting period becomes unignorable for the scan electrodes to which the scan pulses are supplied in the vicinity of the end of the sub-scan period TC1, among the respective scan electrodes within the scan electrode group SCg1. The scan-waiting period is herein a period from the time after the wall charges are accumulated in the setup period ST to the time until the scan pulse is supplied in the writing period TW (w=2, 3, . . . , k). In Embodiment 4, the number by which the total number of the scan electrodes is divided can be made larger than that of Embodiment 1 such that the total number of the scan electrodes is divided into three groups or more. Hence, the scan-waiting period for the scan electrode group SCg1 can be made shorter than that in Embodiment 1. Therefore, an effect close to the effect of the reference raising potential Vpa in the above-mentioned scan electrode group SCgw (w=2, 3, . . . , k) is obtained even in the scan electrode group SCg1.

Even in the k-group configuration, the amount of circuits required for the configuration is less than that for k groups as described above. Hence, the installation area of the PDP drive circuit is reduced. Furthermore, the effect of cost reduction is high due to the reduction in the amount of circuits and in the number of circuit components having high withstand voltages described above.

Even in Embodiment 4, such a configuration as that of Embodiment 2 or 3 can be attained. In this case, the operation and effect of Embodiment 4 are similar to those of Embodiment 2 or 3, and their description is omitted.

The present invention can be used for plasma display panel drive circuits and plasma display devices.

The embodiments having been described above are all examples embodying the present invention. However, the present invention is not limited to these examples, but can be implemented in various examples that can easily be configured by those skilled in the art using the technology of the present invention.

What is claimed is:

1. A plasma display panel drive circuit, in which multiple scan electrodes included in a plasma display panel is divided into at least first and second scan electrode groups, and a setup pulse is supplied in a setup period, scan pulses are supplied in a scan period and sustain pulses are supplied in a sustain period, the plasma display panel drive circuit, comprising:

a first scan electrode group drive section, including a scan peak potential producing section to produce a predetermined peak potential, operable to produce scan pulses based on the scan peak potential and to supply the scan pulses to said first scan electrode group in a first sub-scan period within the scan period;

a second scan electrode group drive section operable to produce scan pulses based on the scan peak potential of said scan peak potential producing section and to supply the scan pulses to said second scan electrode group in a second sub-scan period after the first sub-scan period within the scan period; and a complex switch section operable to supply the scan peak potential of said scan peak potential producing section to said second scan electrode group drive section in the second sub-scan period within the scan period, wherein said complex switch section includes an inter-group switch section operable to supply and shut off the scan peak potential of said scan peak potential producing section to said second scan electrode group drive section, and wherein said inter-group switch section is turned off in the first sub-scan period and turned on in the second sub-scan period.

2. The plasma display panel drive circuit according to claim 1, further comprising:

a sustain pulse producing section operable to produce sustain pulses, wherein said complex switch section supplies the sustain pulses of said sustain pulse producing section to said first and second scan electrode group drive sections in the sustain period, and said first and second scan electrode group drive sections supply the sustain pulses from said complex switch section to said first and second scan electrode groups.

3. The plasma display panel drive circuit according to claim 2, wherein said complex switch section comprises:

a first group switch section operable to supply and to shut off the sustain pulses of said sustain pulse producing section to said first scan electrode group drive section, and a second group switch section operable to supply and to shut off the sustain pulses of said sustain pulse producing section to said second scan electrode group drive section.

4. The plasma display panel drive circuit according to claim 1, wherein said inter-group switch section is turned off in the sustain period.

5. The plasma display panel drive circuit according to claim 1, wherein said first scan electrode group drive section:

includes a first scan reference voltage supply operable to supply a predetermined scan reference voltage and produces scan pulses by producing a scan reference potential having a potential difference of the scan reference voltage with respect to the scan peak potential in the direction of the potential of the setup pulse at the time when the absolute value of the setup pulse becomes maximum and by carrying out switching between the scan peak potential and the scan reference potential in the first sub-scan period, and said second scan electrode group drive section:

includes a second scan reference voltage supply operable to supply a predetermined scan reference voltage and produces scan pulses by producing a scan reference potential having a potential difference of the scan reference voltage with respect to the scan peak potential in the direction of the potential of the setup pulse at the time when the absolute value of the setup pulse becomes maximum and by carrying out switching between the scan peak potential and the scan reference potential in the second sub-scan period.

6. The plasma display panel drive circuit according to claim 1, wherein said second scan electrode group drive section:

includes a second scan reference voltage supply operable to supply a predetermined scan reference voltage and produces a predetermined reference raising potential between the setup peak potential representing the potential of the setup pulse at the time when the absolute value of the setup pulse becomes maximum and the scan reference potential having a potential difference of the scan reference voltage in the direction of the setup peak potential with respect to the scan peak potential in the first sub-scan period.

7. The plasma display panel drive circuit according to claim 6, wherein said second scan electrode group drive section produces a reference raising potential having a potential difference of the scan reference voltage in the direction of the setup peak potential with respect to the ground potential.

8. The plasma display panel drive circuit according to claim 6, wherein said second scan electrode group drive section:

includes an offset potential producing section operable to produce a predetermined offset potential and produces a reference raising potential having a potential difference of the scan reference voltage in the direction of the setup peak potential with respect to the offset potential.

9. The plasma display panel drive circuit according to claim 6, further comprising:

an offset potential producing section operable to produce a predetermined offset potential, wherein said offset potential producing section supplies the offset potential to said second scan electrode group drive section via said complex switch section, and said second scan electrode group drive section produces a reference raising potential having a potential difference of the scan reference voltage in the direction of the setup peak potential with respect to the offset potential.

10. A plasma display device, comprising:

a plasma display panel having scan electrodes, sustain electrodes and data electrodes, discharge cells being formed at the intersection portions of said scan electrodes, said sustain electrodes and said data electrodes; and said plasma display panel drive circuit according to claim 1 for driving said plasma display panel.

11. The plasma display device according to claim 10, wherein said discharge cells of said plasma display panel are filled with a discharge gas containing xenon and the partial pressure of the xenon in the discharge gas is 7% or more.

12. The plasma display device according to claim 10, wherein said plasma display panel drive circuit performs driving based on a single scan system operable to sequentially supply a scan pulse to the respective scan electrodes in the scan period.

13. The plasma display device according to claim 10, wherein said plasma display panel is composed of one million or more pixels.

* * * * *